US005874873A

United States Patent [19]

Hetzmannseder et al.

[11] Patent Number: 5,874,873

[45] Date of Patent: Feb. 23, 1999

[54] ELECTRIC CONTROL APPARATUS

[75] Inventors: Engelbert Hetzmannseder, Shorewood; Earl T. Piber, Oconomowoc; Peter K. Moldovan, Cascade; Kurt V. Eckroth, Oconomowoc; Peter J. Theisen, West Bend, all of Wis.

[73] Assignee: Eaton Corporation, Cleveland, Ohio

[21] Appl. No.: 918,545

[22] Filed: Aug. 22, 1997

[51] Int. Cl.[6] ..... H01H 75/00

[52] U.S. Cl. ..... 335/16; 335/201; 218/1; 218/22

[58] Field of Search ..... 335/16, 147, 195, 335/201; 218/22, 24, 26–7, 29, 30, 31, 1, 2, 15, 16, 17

[56] References Cited

U.S. PATENT DOCUMENTS 3,815,059 6/1974 Spoelman .
4,810,841 3/1989 Wolf .
5,073,764 12/1991 Takahashi et al. .
5,495,083 2/1996 Aymami-Pala et al. .

*Primary Examiner*—Lincoln Donovan
*Attorney, Agent, or Firm*—Tarolli, Sundheim, Covell, Tummino & Szabo

[57] ABSTRACT

An electric motor control apparatus includes an electrical current control apparatus which is operable to limit current to an electric motor. When the electric motor is a three-phase motor, three current limiting switch assemblies are provided in the electric current control apparatus. A single stack of laminations concentrates magnetic fields emanating from conductors in all three current limiting switch assemblies. Each of the current limiting switch assemblies includes two movable contacts which are mounted on contact arms. The contact arms are movable in slots in the stack of laminations. A first series of splitter plates is disposed in an array along a path of movement of the contact on the first movable contact arm and a second series of splitter plates is disposed along a path of movement of the contact on the second contact arm for each of the current limiting switch assemblies. A short circuit splitter plate conducts electrical current between the two series of splitter plates. A bypass splitter plate is connected in a bypass circuit which conducts excessive current around a motor starter to protect the motor starter.

31 Claims, 10 Drawing Sheets

ELECTRIC CONTROL APPARATUS

BACKGROUND OF THE INVENTION

The present invention r elates to an electric control apparatus which may be utilized to limit current flow to an electrical device, such as an electric motor.

A known electrical control apparatus includes a pair of parallel stationary contact arms and a pair of movable contact arms. The movable contact arms are connected in series with each other. Electric current flows in opposite directions in the adjacent stationary contact arms and movable contact arms. Opposition between magnetic fields emanating from current conducted through the movable and stationary contact arms causes the movable contact arms to open an electrical circuit when there is an excessive flow of current through the circuit.

An electric control apparatus having this construction is disclosed in U.S. Pat. No. 5,073,764. Other known electric control apparatus is disclosed in U.S. Patents Nos. 3,815,059; 4,810,841; and 5,495,083.

SUMMARY OF THE INVENTION

A control apparatus for a device, such as an electric motor, includes an electric current control apparatus. The electric current control apparatus may include two sets of contacts. One contact in each set of contacts is mounted on a movable contact arm. The movable contact arms may be movable under the influence of opposition between magnetic fields.

The movable contact arms are advantageously movable along slots disposed in a stack of laminations. The laminations concentrate magnetic fields emanating from electric current conducted through the movable contact arms. When the control apparatus is utilized with a three-phase electric motor, the electric current control apparatus may include three current limiting switch assemblies having contact arms which are movable in slots formed in a single stack of laminations.

In one embodiment of the invention, a first series of splitter plates is disposed along the path of movement of one of the contact arms in a current limiting switch assembly. A second series of splitter plates is disposed along the path of movement of a second contact arm in the current limiting switch assembly. The splitter plates receive electrical arcing upon operation of the current limiting switch assembly from a closed condition to an open condition.

One of the splitter plates may be connected in a bypass circuit which protects a device, such as a motor starter, by conducting excessive current flow around the device. A common splitter plate may be provided to conduct current directly between the two series of splitter plates rather than through the movable contact. During operation of contacts from a closed condition to an open condition, hot gases associated with electrical arcing are directed toward the splitter plates by at least partially blocking ends of the slots in the stack of laminations.

BRIEF DESCRIPTION OF THE DRAWINGS

The foregoing and other features of the invention will become more apparent upon a consideration of the following description taken in connection with the accompanying drawings, wherein.

DESCRIPTION OF THE ONE SPECIFIC PREFERRED EMBODIMENT OF THE INVENTION

General Description

Figure 1:
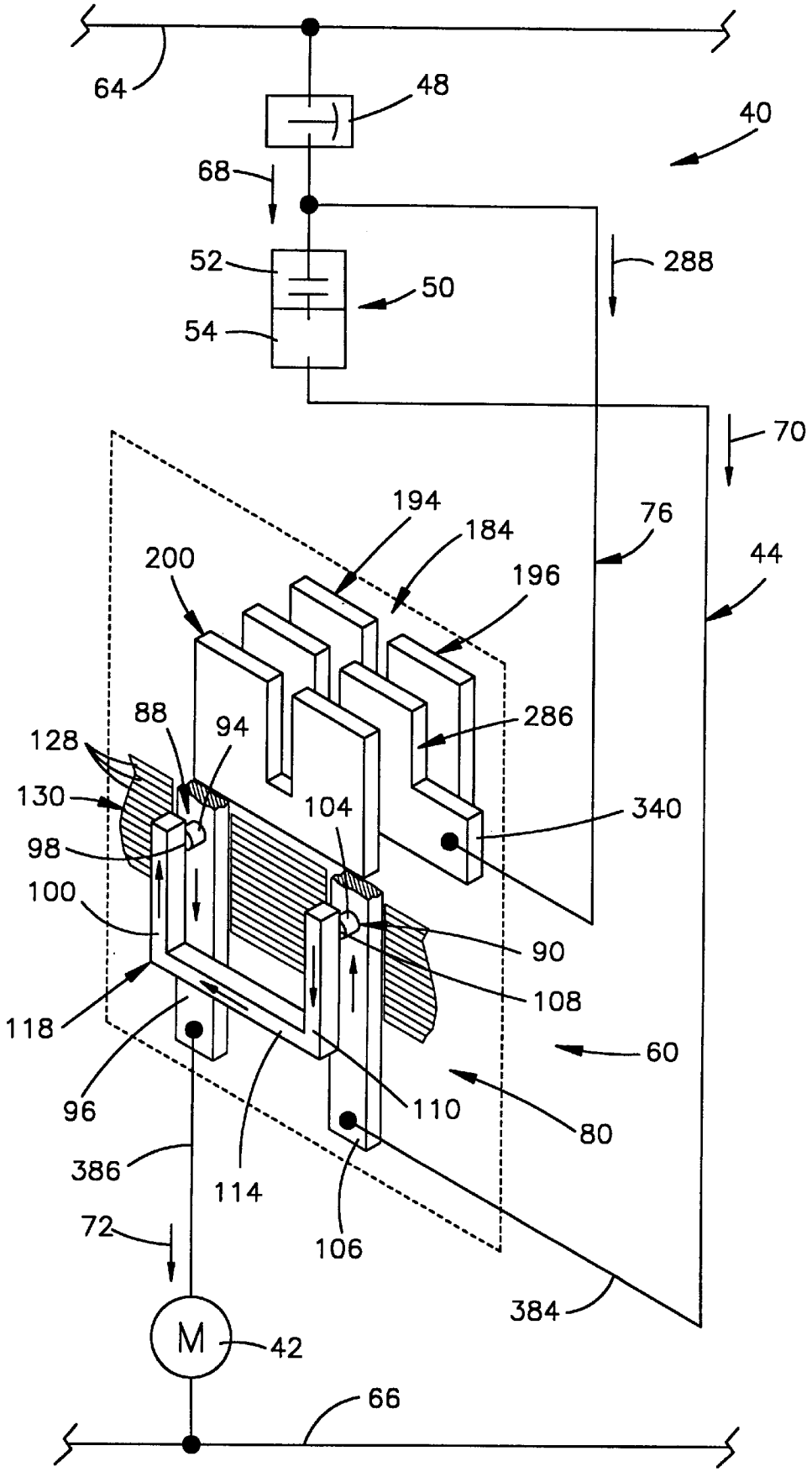
FIG. 1 is a schematic illustration of an electric motor control apparatus which is constructed in accordance with the present invention.

An electric control apparatus 40, constructed in accordance with the present invention, for use in controlling an electric motor 42 is illustrated schematically in FIG. 1. It should be understood that the electric control apparatus 40 could be utilized to control electrical devices other than the electric motor 42, for example, a wire. The electric motor control apparatus 40 includes a main circuit 44 which conducts electrical current to the motor 42 during normal operation of the motor.

The main circuit 44 includes a known motor circuit protector or circuit breaker 48. The motor circuit protector 48 is magnetically tripped by severe fault currents through the main circuit 44. When the motor circuit protector 48 is tripped, it is latched in an open condition in which the main circuit 44 is interrupted.

The main circuit 44 also includes a known motor starter 50. The motor starter 50 includes a contactor 52 which is operated from an open condition to a closed condition to initiate operation of the motor 42. In addition, the motor starter 50 includes an overload relay 54 having a thermal element. The thermal element in the overload relay 54 heats up as a function of current through the element and causes the relay to trip open to interrupt electrical current through the main circuit 44 to the motor 42 in the event of abnormal current flow. Although a motor starter 50 having one specific known construction has been illustrated in FIG. 1, it should be understood that the motor starter 50 could have a construction which is different from the illustrated construction.

An electric current control apparatus 60, constructed in accordance with the present invention, is disposed in the main circuit 44. The electric current control apparatus 60 responds very quickly to an excessive flow of electrical current to the motor 42 to protect the motor starter 50. The electric current control apparatus 60 protects the motor starter 50 by interrupting current flow through the motor and motor starter before the motor circuit protector 48 has had time to interrupt current flow.

Upon a serious malfunctioning of the electric motor 42, excessive current flow may be caused by a shorting out of components of the motor. Only a very small initial portion of the prospective current is conducted to the motor 42 through the motor starter 50. This is because the electric current control apparatus 60 rapidly opens the main circuit 44 and interrupts the flow of current through the motor starter 50.

During normal operation of the electric motor, three phase alternating current is conducted from power lines 64 and 66 to the electric motor 42 through the motor starter 50 and main circuit 44. The power lines 64 and 66 are connected with a source of three phase alternating current potential which may have a voltage of approximately 277 volts. Of course, other AC voltages or even DC voltage could be utilized if desired. Although the power lines 64 and 66 are connected with a source of alternating current, for purposes of simplicity of description, current flow is assumed herein as being in the direction of arrows 68, 70 and 72 in FIG. 1.

A bypass circuit 76 is provided, through the electric current control apparatus 60, to conduct electrical current around the motor starter 50 upon initiation of a flow of excessive current to the motor 42. By conducting the excessive electrical current around the motor starter 50, the bypass circuit 76 protects the motor starter against damage by the excessive flow of electrical current to the motor 42. However, the bypass circuit 72 may be eliminated and the electric current control apparatus 60 solely utilized to protect the electric motor starter 50 against excessive current flow. When the bypass circuit 76 is eliminated, the extremely fast acting electric current control apparatus 60 opens the main circuit 44 to interrupt current flow through the motor starter 50 to the electric motor 42 before the motor circuit protector 48 has had time enough to respond to the initiation of excessive current flow.

Upon initiation of a flow of excessive current to the motor 42 through the main circuit 44, the electric current control apparatus 60 is quickly operated. Operation of the electric current control apparatus 60 immediately opens the main circuit 44 to interrupt the flow of electrical current through the motor 42 and motor starter 50. In addition, operation of the electric current control apparatus 60 results in excessive electrical current being conducted around the motor starter 50 through the bypass circuit 76.

Upon operation of the electric current control apparatus 60, the bypass circuit 76 connects the motor 42 with the power line 64 through the motor circuit protector 48 and through the electric current control apparatus 60. After the electric current control apparatus 60 has been actuated, the motor circuit protector 48 operates to interrupt the flow of current between the power lines 64 and 66. Opening of the motor circuit protector 48 interrupts the flow of current through both the bypass circuit 76 and the main circuit 44. After the motor circuit protector 48 has been latched in an open or actuated condition, the electric current control apparatus 60 returns to its initial or unactuated condition.

Although a single phase motor circuit protector 48 and motor starter 50 have been illustrated schematically in FIG. 1, it should be understood that the power lines 64 and 66 are a source of three phase alternating voltage. Therefore, the electric motor 42, circuit protector 48, motor starter 50 and electric current control apparatus 60 have three phase construction. The electric current control apparatus 60 is associated with each of the three phases of the electric motor 42 to protect the motor starter 50 against excessive current flows in each of the three phases.

Figure 2:
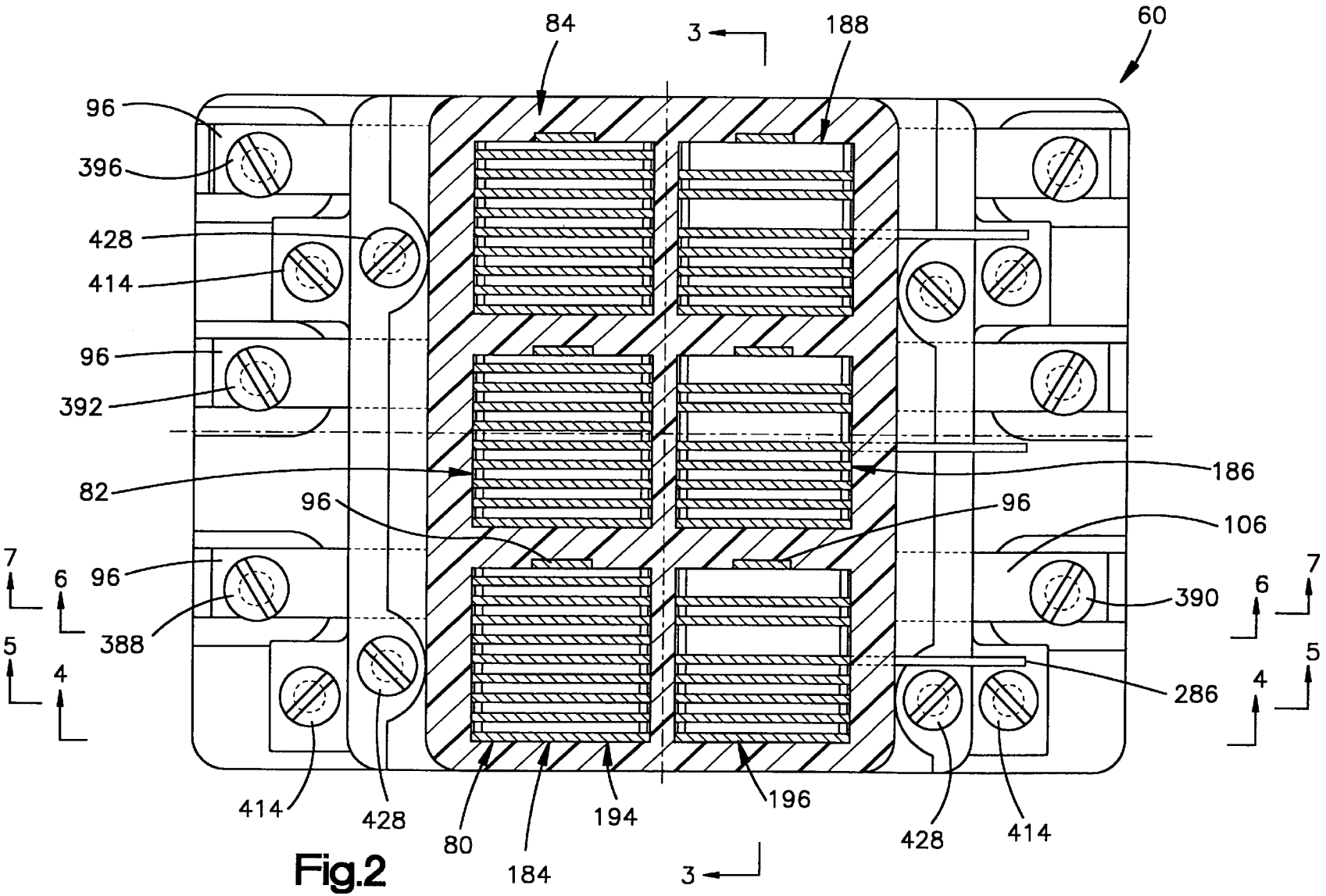
FIG. 2 is a partially broken away top plan view of an electric current control apparatus constructed in accordance with the present invention and utilized in the electric motor control apparatus of FIG. 1.
Figure 3:
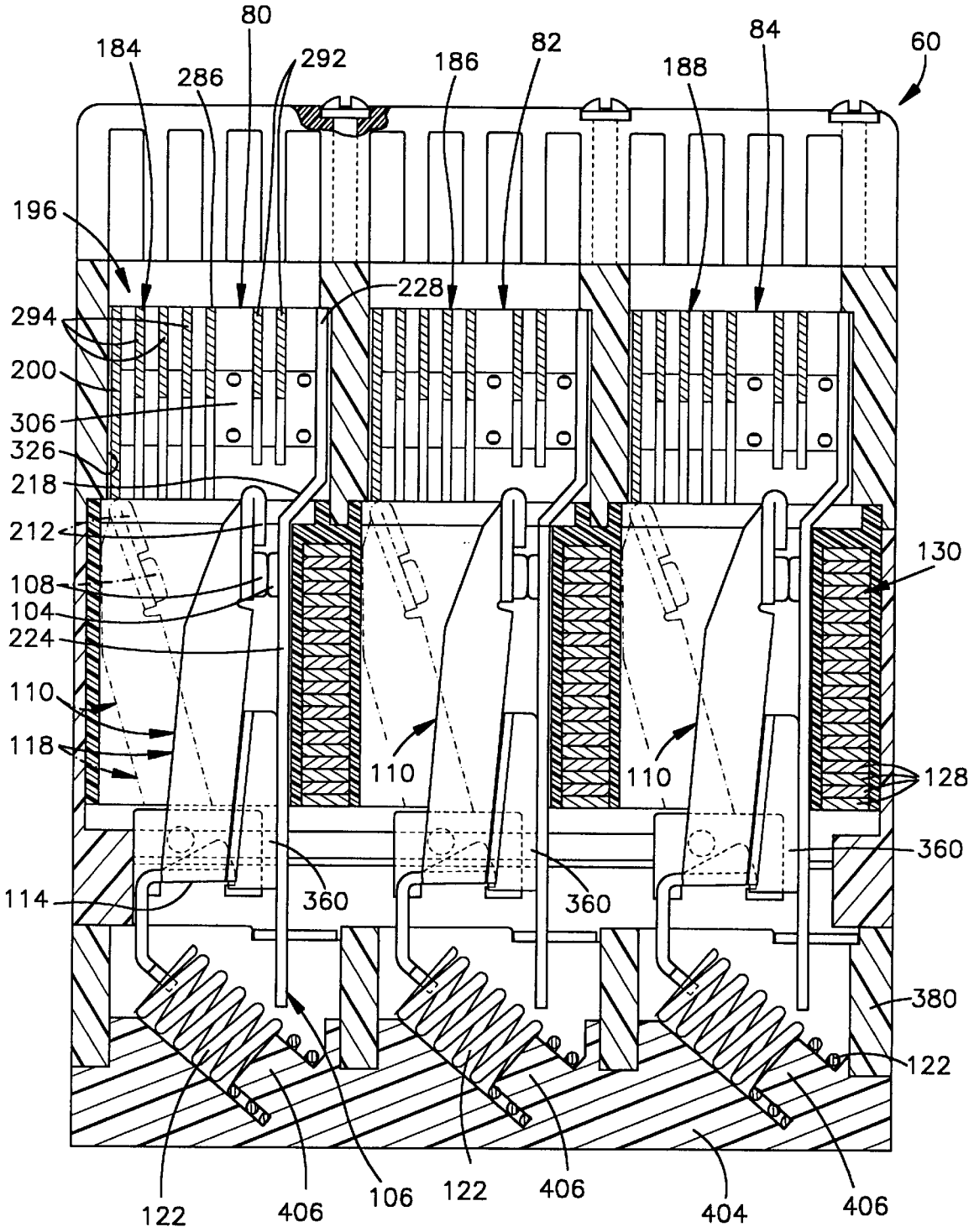
FIG. 3 is a sectional view, taken generally along the view line 3—3 of FIG. 2 and illustrating the relationship between a plurality of switch assemblies and a plurality of splitter plate assemblies in the electric current control apparatus.

The electric current control apparatus 60 includes a current limiting switch assembly 80. Although only a single current limiting switch assembly 80 has been illustrated schematically in FIG. 1, the electric current control apparatus 60 includes three current limiting switch assemblies 80, 82 and 84 (FIGS. 2 and 3). There is a separate current limiting switch assembly 80, 82 or 84 for each of the three phases of the electric motor 42.

The three current limiting switch assemblies 80, 82 and 84 have the same construction and mode of operation. The three current limiting switch assemblies 80, 82 and 84 are connected in series with the motor 42 and motor starter 50 in the main circuit 44. Each of the current limiting switch assemblies 80, 82 and 84 functions to protect the motor starter 50 against excessive current flow in one or more of the three phases of the electric motor.

Current Limiting Switch Assembly

The current limiting switch assembly 80 includes two sets of contacts, that is, a left (as viewed in FIGS. 1 and 4) set 88 of contacts and a right set 90 of contacts. The left and right sets of contacts 88 and 90 are connected in series with each other, with the motor 42 and with the motor starter 50 (FIG. 1). During normal operation of the electric motor 42, the left and right sets of contacts 88 and 90 are in a closed condition. Electric current is conducted through the two sets of contacts 88 and 90 to the motor 42 in the manner indicated schematically by the arrows 68, 70 and 72 in FIG. 1 for the assumed direction of current flow.

Figure 8:
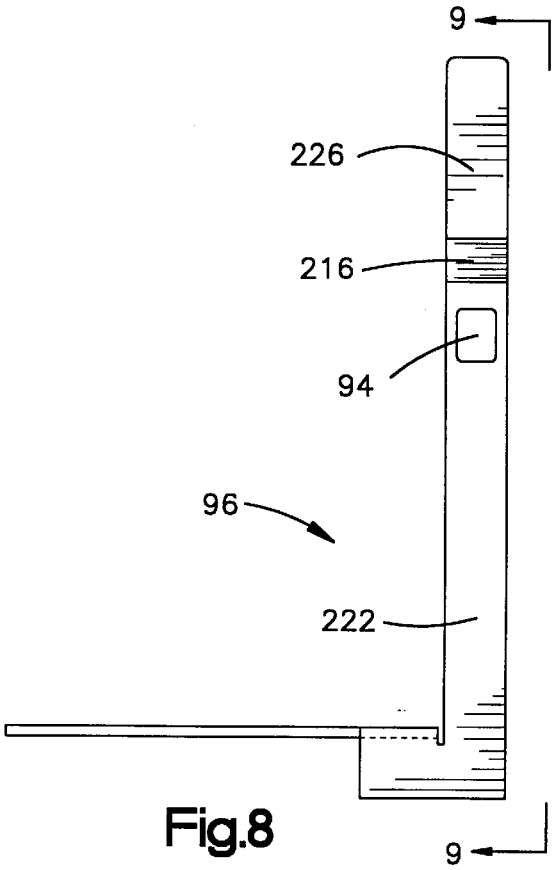
FIG. 8 is an enlarged plan view of a stationary contact arm conductor used in the one switch assembly.
Figure 9:
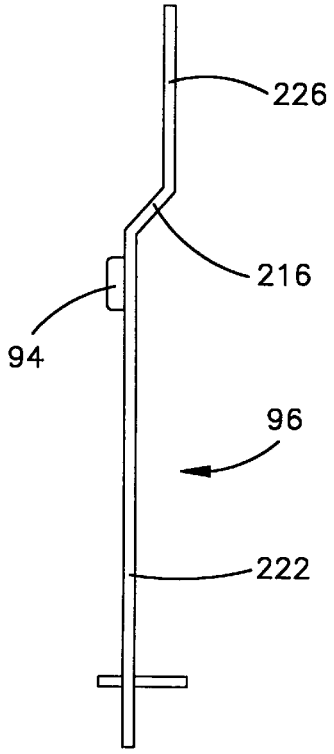
FIG. 9 is a side view, taken generally along the line 9—9 of FIG. 8, further illustrating the construction of the stationary contact arm.

The left set 88 (FIG. 1) of contacts includes a fixed contact 94 (FIGS. 1, 8 and 9) disposed on a stationary contact arm 96 and a movable contact 98 (FIGS. 1, 10 and 11) disposed on a movable contact arm 100. Similarly, the right set 90 (FIG. 1) of contacts includes a fixed contact 104 (FIGS. 1 and 3) disposed on a stationary contact arm 106 and a movable contact 108 disposed on a movable contact arm 110.

Figure 4:
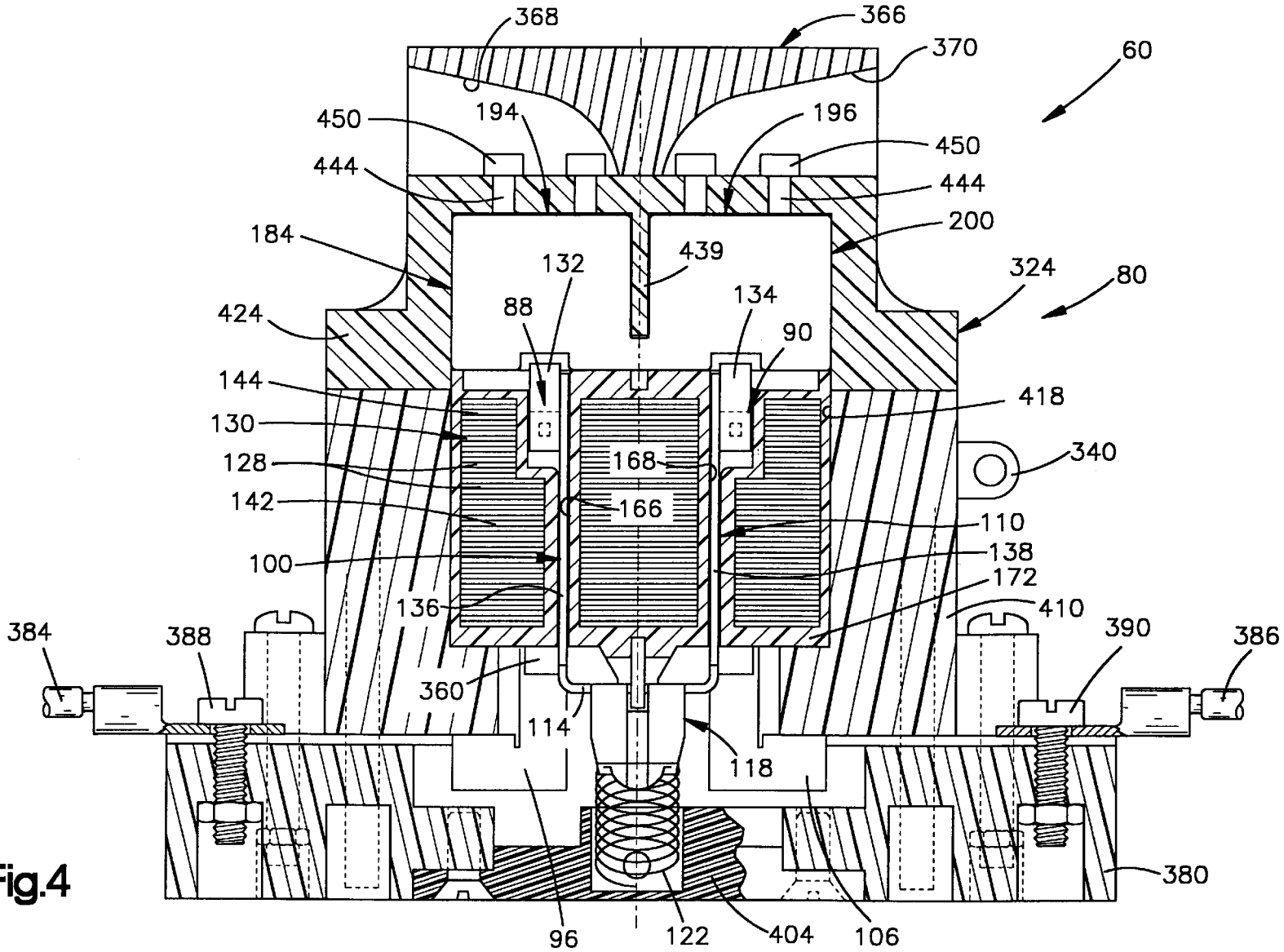
FIG. 4 is a sectional view, taken generally along the line 4—4 of FIG. 2, illustrating the relationship of a common or short circuit splitter plate in one of the splitter plate assemblies to one of the switch assemblies in the electric current control apparatus.
Figure 10:
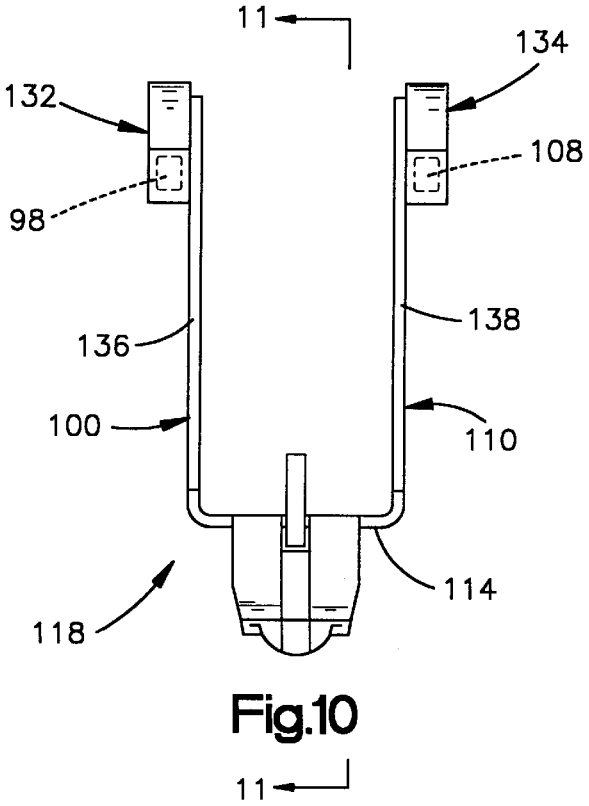
FIG. 10 is an elevational view of a movable contact member having a pair of arms or conductors used in the one switch assembly.
Figure 11:
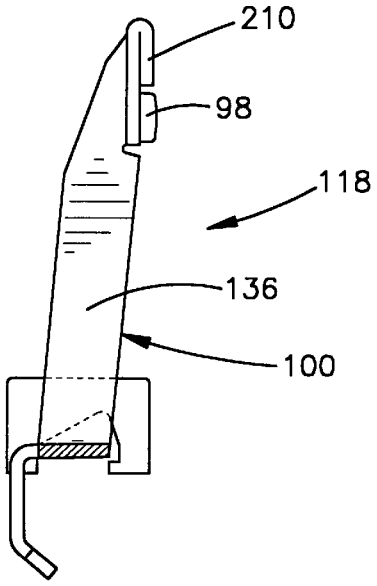
FIG. 11 is a sectional view, taken generally along the line 11—11 of FIG. 10, further illustrating the construction of one of the movable contact arms.

The movable contact arms 100 and 110 are interconnected by a connector section 114 (FIGS. 1, 4 and 10). The contact arms 100 and 110 and the connector section 114 are integrally formed from one piece of electrically conductive material, that is, copper. The movable contact arms 100 and 110 and connector section 114 form a generally U-shaped one-piece contactor or contact carrier 118. The U-shaped contactor 118 is pivotal about an axis which extends through the connector section 114 perpendicular to the movable contact arms 100 and 110.

The connector section 114 transmits force and electrical current between the movable contact arms 100 and 110. Thus, the connector section 114 transmits force between the movable contact arms 100 and 110 to effect simultaneous pivotal movement of the movable contact arms 100 and 110 between open and closed conditions. In addition, the connector section 114 conducts electrical current between the movable contact arms 100 and 110 during operation of the electric motor 42 (FIG. 1).

During operation of the electric motor 42, the left and right sets of contacts 88 and 90 (FIG. 1) are closed. Therefore, electrical current is conducted between the stationary metal contact arms 96 and 106 through the movable contact arms 100 and 110 and connector section 114. Assuming a current flow direction indicated by the arrows 70 and 72 in FIG. 1, there is an upward, as viewed in FIG. 1, current flow in the stationary contact arm 106, in the manner indicated by an arrow in FIG. 1. This current flows through the closed right set of contacts 90 into the movable contact arm 110. The current flow in the movable contact arm 110 is downward, in the manner indicated by an arrow in FIG. 1.

Current is conducted from the movable contact arm 110 across the connector section 114. Assuming a direction of current flow indicated by the arrows 70 and 72 in FIG. 1, the current will flow across the connector section 114 from right to left, in the manner indicated by an arrow in FIG. 1. The current is then conducted upward through the movable contact arm 100 to the closed left set of contacts 88. The current then flows downward through the stationary contact arm 96 to the electric motor 42.

It should be understood that the assumed directions of current flow, indicated by arrows in FIG. 1, is only for an instant. The direction of current flow is subsequently reversed. This is because the power lines 64 and 66 are connected with a source of three phase alternating current. The directions of current flow indicated in FIG. 1 have been assumed only to facilitate description of the apparatus.

The stationary contact arms 96 and 106 are disposed adjacent to the movable contact arms 100 and 110 (FIGS. 1 and 4). At any given time, the current flow in the movable contact arms is opposite from the direction of current flow in the adjacent stationary contact arms. Therefore, magnetic fields emanating from the current flow in the adjacent stationary and movable contact arms oppose each other. The opposition between the magnetic fields urges the U-shaped contactor 118 to pivot from the closed position, shown in solid lines in FIG. 3 toward the open position, shown in dashed lines in FIG. 3. A biasing spring 122 urges the U-shaped contactor 118 toward the closed position shown in solid lines in FIG. 3.

During normal operation of the motor 42, the magnetic fields emanating from the current flowing to the motor have insufficient strength to move the U-shaped contactor 118 against the influence of the biasing spring 122. However, upon initiation of excessive current flow to the electric motor 42, the strength of the magnetic fields emanating from the current conducted to the motor 42 increases. Due to the increased strength of the magnetic fields, opposition between the magnetic fields is effective to pivot the U-shaped contactor 118 from the closed position illustrated in solid lines in FIG. 3 to the open position illustrated in dashed lines in FIG. 3 against the influence of the biasing spring 122.

Assuming the direction of current flow indicated by the arrows 70 and 72 in FIG. 1, during normal operation of the motor 42 with the left and right sets of contacts 88 and 90 in the closed condition, the movable contact arm 100 extends generally parallel to and is closely adjacent to the stationary contact arm 96. Since the electrical current is flowing in opposite directions through the stationary contact arm 96 and movable contact arm 100, the magnetic field emanating from the electrical current flowing through the stationary contact arm 96 opposes the magnetic field emanating from the electrical current flowing through the movable contact arm 100. The magnetic repulsion forces between the two magnetic fields are insufficient to move the movable contact arm 100 against the influence of the biasing spring 122. Therefore, the left set of contacts 88 remains in the closed condition.

Similarly, during normal operation of the electric motor 42, the right movable contact arm 110 is adjacent to and extends generally parallel to the right stationary contact arm 106. At this time, the current flows in one direction, that is downward, in the movable contact arm 110 and in the opposite direction, that is upward, in the stationary contact arm 106. Due to the opposite directions of current flow, the magnetic fields emanating from the current in the movable contact arm 110 opposes the magnetic field emanating from the current in the stationary contact arm 106. However, the strength of the magnetic fields is insufficient to move the movable contact arm 110 against the influence of the biasing spring 122 (FIG. 3).

Upon initiation of excessive current flow to the motor 42 (FIG. 1), the strength of the magnetic fields emanating from current conducted through the stationary contact arms 96 and 106 and movable contact arms 100 and 110 increases. The combined opposition between the magnetic fields is sufficient to cause the U-shaped contactor 118 to pivot in a counterclockwise direction (as viewed in FIG. 3) against the influence of the biasing spring 122. As this occurs, the left and right sets of contacts 88 and 90 are opened to interrupt the flow of excessive current to the electric motor 42.

Although the foregoing description has been in association with the current limiting switch assembly 80 for one phase of the three phase electric motor 42, it should be understood that the current limiting switch assemblies 82 and 84 (FIGS. 2 and 3) for the other two phases of the electric motor 42 have the same construction as the current limiting switch assembly 80. Therefore, upon initiation of an excessive current flow to the electric motor 42, the current limiting switch assemblies 80, 82 and 84 are all operated to an open condition to quickly interrupt the flow of excessive current through the motor starter 50 to the electric motor 42.

After the current limiting switch assemblies 80, 82 and 84 have operated from the closed condition, the motor circuit protector 48 will have had sufficient time to operate from a closed condition to an open condition. As the motor circuit protector 48 operates from the closed condition to an open condition, the motor circuit protector is latched in the open condition. Opening of the motor circuit protector 48 interrupts current flow in the main circuit 44.

The motor circuit protector 48 operates at the same time with the current limiting switch assemblies 80, 82 and 84, but more slowly than these assemblies. Before the current limiting switch assemblies 80, 82 and 84 can reclose, the motor circuit protector 48 will have opened. Therefore, the flow of electrical current to the motor 42 remains interrupted even though the current limiting switch assemblies 80, 82 and 84 are returned to their initial or closed conditions by biasing springs, corresponding to the biasing spring 122, in each of the current limiting switch assemblies 80, 82 and 84.

Laminations

In accordance with one of the features of the present invention, the current limiting switch assemblies 80, 82 and 84 are all associated with laminations 128 disposed in a single stack 130 (FIGS. 1, 3 and 4). The laminations 128 are formed of magnetizable material, specifically steel. The laminations 128 are effective to concentrate magnetic flux emanating from current being conducted through the stationary contact arms 96 and 106 and through the movable contact arms 100 and 110 in the current limiting switch assemblies 80, 82 and 84.

The stack 130 of laminations encloses components of all three current limiting switch assemblies 80, 82 and 84. Thus, the current limiting switch assemblies 80, 82 and 84 have a common stack 130 of laminations which is utilized to concentrate magnetic flux in all three of the current limiting switch assemblies. By using a common stack 130 of laminations for the three current limiting switch assemblies 80, 82 and 84, the rigidity of the electric current control apparatus 60 is increased. In addition, assembly of the three current limiting switch assemblies 80, 82 and 84 in the unitary electric current control apparatus 60 is facilitated.

The stationary contact arms 96 and 106 and movable contact arms 100 and 110 in each of the current limiting switch assemblies 80, 82 and 84 extend through slots in the laminations 128. The slots in the laminations are sized so as to be closely adjacent to the movable contact arms 100 and 110 in each of the current limiting switch assemblies.

The movable contact arms 100 and 110 (FIGS. 4 and 10) have wide head end portions 132 and 134 and narrow body portions 136 and 138. Thus, as viewed in a plane extending perpendicular to the path of movement of the U-shaped contacts 118 between the open and closed positions, the head end portions 132 and 134 are wider than the body portions 136 and 138 (FIG. 10). Both the head end portions 132 and 134 and the body portions 136 and 138 are disposed in the slots in the stack 130 of laminations. The slots in the rectangular stack 130 of laminations are sized so as to enable the laminations to be as close as is reasonably possible to the movable contact arms 100 and 110 as they move between the closed and open positions.

The single stack 130 of laminations includes a lower series 142 of laminations and an upper series 144 of laminations (FIG. 4). The lower series 142 of laminations is formed of steel sheet metal laminations 148 (FIG. 13) having slots 150 with a relatively narrow configuration. The upper series 144 of laminations (FIG. 4) is formed of steel sheet metal laminations 154 (FIG. 12) having relatively large slots 156. The slots 156 in the laminations 154 of the upper series 144 of laminations are relatively wide to accommodate the relatively wide head end portions 132 and 134 (FIG. 10) on the U-shaped movable contactor 118.

Figure 12:
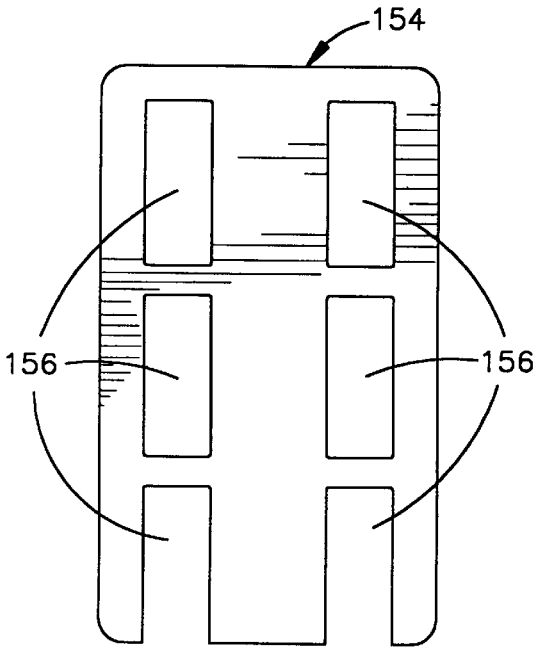
FIG. 12 is a plan view of an upper lamination utilized in the electric current control apparatus of FIG. 2.

The slots 150 in the laminations 148 which form the lower series 142 (FIG. 4) of laminations are relatively small. Thus, the slots 150 in the lower lamination 148 (FIG. 13) have a generally rectangular main or body section 160 which is substantially narrower than the slots 156 in the upper laminations 154. Each of the slots 150 in the lower lamination 148 has an end portion 162 which is as wide as the slots 156 in the upper lamination 154 (FIG. 12). The wide end portions 162 of the slots 150 (FIG. 13) in the lower laminations 148 enable the head end portions 132 and 134 of the movable contact arms 100 and 110 to be inserted in assembly through the lower series 142 of laminations upward (as viewed in FIG. 4) into the upper series 144 of laminations.

The laminations 148 in the lower series 142 of laminations and the laminations 154 in the upper series 144 of laminations cooperate to define a pair of slots or openings 166 and 168 (FIG. 4). The stationary contact arms 96 and 106 and the movable contact arms 100 and 110 extend through the slots 166 and 168. The slots 166 and 168 in the stack 130 of laminations are formed by the slots 150 and 156 in the lower laminations 148 and the upper laminations 154.

Although only the slots 166 and 168 for the current limiting switch assembly 80 are illustrated in FIG. 4, it should be understood that a pair of slots having the same configuration as the slots 166 and 168 are formed in the stack 130 of laminations for each of the current limiting switch assemblies 80, 82 and 84. The movable and stationary contact arms for the current limiting switch assemblies 82 and 84 extend through slots in the stack 130 of laminations in the same manner as in which the stationary contact arms 96 and 106 and movable contact arms 100 and 110 for the current limiting switch assembly 80 extend through the slots 166 and 168 (FIG. 4).

The connector section 114 of the U-shaped contactor 118 is disposed beneath the stack 130 of laminations (FIG. 4). The U-shaped contactor 118 is pivotal about an axis which extends through the connector section 114 in a direction parallel to major side surfaces of the laminations 128 in the stack 130 of laminations. The axis about which the U-shaped contactor pivots extends perpendicular to longitudinal central axes of the movable contact arm 100 and 110.

The movable contacts 98 and 108 (FIG. 1) on the movable contact arms 100 and 110 (FIG. 4) are disposed in the slots 166 and 168. The head end portions 132 and 134 project upward from the slots 166 and 168 in the stack 130 of laminations. The fixed contacts 94 and 104 on the stationary contact arms 96 and 106 (FIG. 1) are also disposed in the slots 166 and 168 (FIG. 4).

Figure 13:
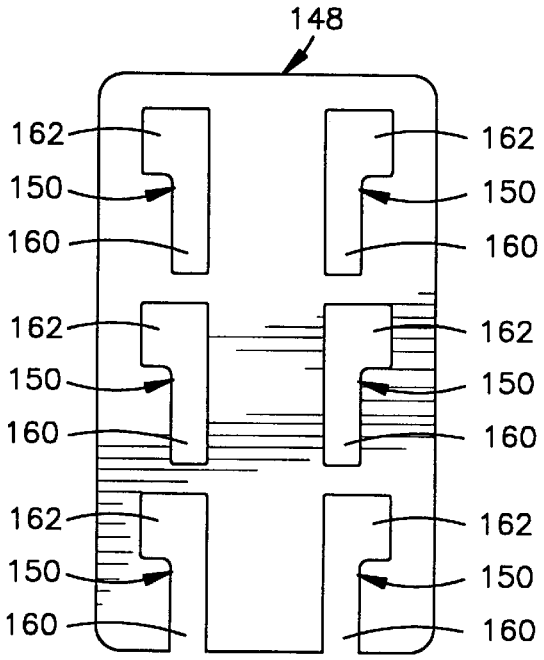
FIG. 13 is a plan view of a lower lamination utilized in the electric current control apparatus of FIG. 2.
Figure 14:
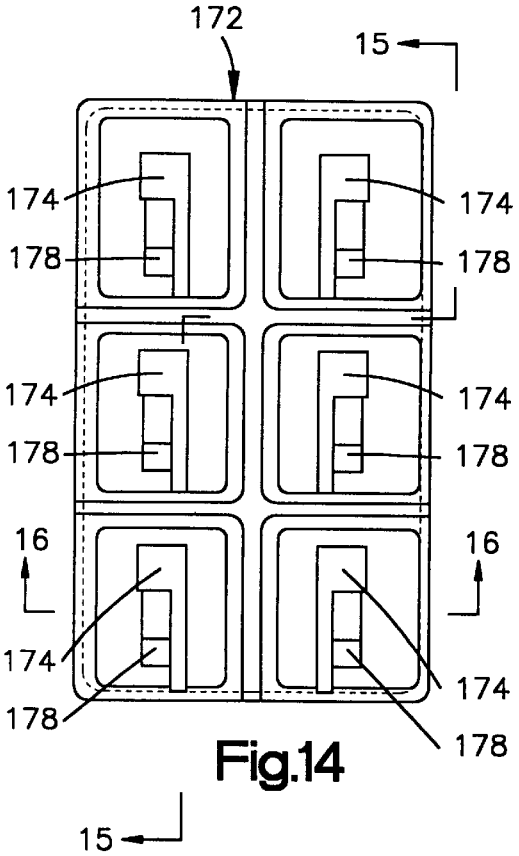
FIG. 14 is a top plan view of a housing which encloses a stack of the laminations of FIGS. 12 and 13.
Figure 15:
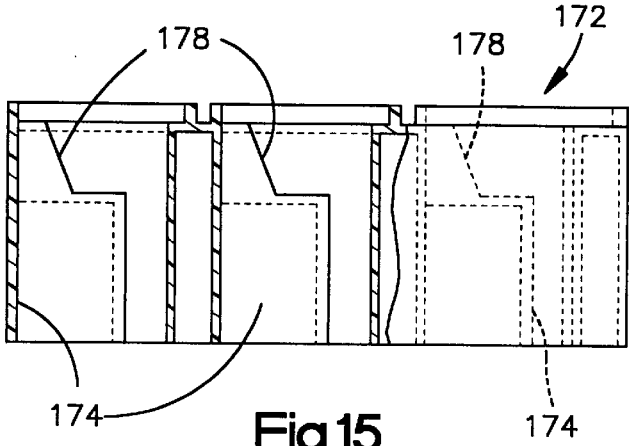
FIG. 15 is a sectional view, taken generally along the line 15—15 of FIG. 14, further illustrating the construction of the housing for the stack of laminations.
Figure 16:
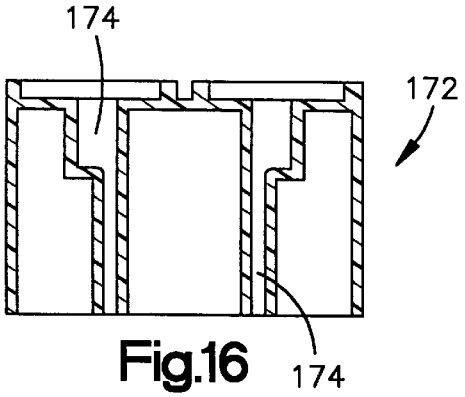
FIG. 16 is a sectional view, taken generally along the line 16—16 of FIG. 14, further illustrating the constructions the housing for the stack of laminations.

The rectangular stack 130 of laminations is enclosed by a lamination housing 172 (FIGS. 4, 14, 15 and 16). The rectangular lamination housing 172 is molded of an electrically insulating polymeric material. The lamination housing 172 has a plurality of slots 174 (FIGS. 14 and 16) which extend through the slots 150 and 156 in the lower and upper laminations 148 and 154 (FIGS. 12 and 13). The slots 174 in the lamination housing 172 extend through the housing (FIG. 16). The lamination housing 172 extends through the slots 150 and 156 to position the laminations 148 and 154 relative to each other.

The slots 174 (FIGS. 14 and 15) have stop surfaces 178 which engage the head end portions 132 and 134 (FIG. 10) on the movable contact arms 100 and 110 of the U-shaped movable contactor 118. The stop surfaces 178 engage the head end portions 132 and 134 on the contact arms 100 and 110 to prevent deflection of the head end portions 132 and 134 of the contact arm relative to the body portions 136 and 138 during rapid movement and abrupt stop of the movable contact arms 100 and 110 to an open position. Thus, if the stop surfaces 178 (FIG. 15) are omitted, the inertia of the head portions 132 and 134 (FIG. 10) may cause bending of the movable contact arms 100 and 110 when the contact arms reach the ends of their operating strokes, shown in dashed lines in FIG. 3.

Splitter Plate Assemblies

Each of the current limiting switch assemblies 80, 82 and 84 includes a splitter plate assembly. Thus, the current limiting switch assembly 80 includes a splitter plate assembly 184 (FIG. 3), the current limiting switch assembly 82 includes a splitter plate assembly 186, and the current limiting switch assembly 84 includes a splitter plate assembly 188. The splitter plate assemblies 184, 186 and 188 all have the same construction and are electrically isolated from each other. The splitter plate assemblies 184, 186 and 188 facilitate extinguishing electrical arcing upon operation of the current limiting switch assemblies 80, 82 and 84 from the closed condition to the open condition.

The identical splitter plate assemblies 184, 186 and 188 receive electrical arcing upon operation of the associated current limiting switch assemblies 80, 82 and 84 from a closed condition to an open condition. The splitter plate assemblies 184, 186 and 188 are formed by a plurality of flat parallel splitter plates of electrically conducting material. Upon opening of the contacts in the current limiting switch assemblies 80, 82 and 84, electrical arcs are driven into the splitter plate assemblies 184, 186 and 188 and are divided into a plurality of segments which are relatively easy to extinguish. This tends to minimize arcing between contacts of the current limiting switch assemblies 80, 82 and 84 as they are operated from their closed condition to their open condition.

In accordance with one of the features of the present invention, each of the splitter plate assemblies 184, 186 and 188 includes two separate series of splitter plates. Thus, the splitter plate assembly 184 includes a left series 194 of splitter plates and a right series 196 of splitter plates (FIGS. 1, 5, 6 and 7). The splitter plates in the left and right series 194 and 196 of splitter plates are electrically isolated from each other. Thus, electrically insulating material is disposed between the left and right series 194 and 196 of splitter plates.

A common or short circuit splitter plate 200 (FIG. 4) extends between the left series 194 and right series 196 of splitter plates. The common splitter plate 200 is disposed adjacent ends of the parallel paths of movement of the movable contact arms 100 and 110 from the closed condition to the open condition. The common splitter plate 200 is electrically isolated from the splitter plates in the left series 194 of splitter plates and the right series 196 of splitter plates. However, upon movement of the movable contact arms 100 and 110 (FIG. 1) toward their fully open position, electrical energy is conducted by the common splitter plate 200 from splitter plates in the left series 194 of splitter plates to splitter plates in the right series 196 of splitter plates.

As the movable contact arm 100 approaches its fully open position, electrical arcing occurs between the common splitter plate 200 and splitter plates of the left series 194 of splitter plates. Similarly, electrical arcing occurs between the common splitter plate 200 and the right series 196 of splitter plates. The common splitter plate 200 enables electrical energy to be conducted between the two series 194 and 196 of splitter plates as the contact arms 100 and 110 approach their fully open positions.

The movable contact arms 100 and 110 (FIGS. 3 and 11) have metal (copper) arc runners 210 and 212 which extend from a location adjacent to the movable contacts 98 and 108 to a location adjacent to the left and right series 194 and 196 of splitter plates. Thus, the arc runner 212 on the right movable contact arm 110 (FIG. 3) extends from a location adjacent to the movable contact 108 to a location adjacent to the right series 196 of splitter plates in the splitter plate assembly 184. The arc runner 210 on the left movable contact arm 100 (FIG. 11) extends from a location adjacent to the movable contact 98 to a location adjacent to the left series 194 of splitter plates in the splitter plate assembly 184.

Upon movement of the movable contact arm 110 from the closed position shown in solid lines in FIG. 3 to the open position shown in dashed lines in FIG. 3, an electrical arc is conducted from the movable contact 108 upward (as viewed in FIG. 3) to the arc runner 212. This electrical arc then extends to the splitter plates in the right series 196 of splitter plates. During operation of the current limiting switch assembly 80 from the closed condition to the open condition, an arc moves from the arc runner 210 on the left movable contact arm 100 to the left series 194 (FIG. 1) of splitter plates. The arc runners 210 and 212 cooperate with the left and right series 194 and 196 of splitter plates to promote movement of an electrical arc upward into the splitter plates and away from the movable contacts 98 and 108 on the movable contact arms 100 and 110.

The one-piece metal (copper) stationary contact arms 96 (FIG. 9) and 106 (FIG. 3) have arc runners 216 (FIG. 9) and 218 (FIG. 3). The arc runners 216 and 218 connect body portions 222 (FIG. 9) and 224 (FIG. 3) on the stationary contact arms 96 and 106 with upper end portions 226 (FIG. 9) and 228 (FIG. 3) of the stationary contact arms 96 and 106. Upon operation of the current limiting switch assembly 80 from the closed condition to the open condition, an arc moves up the arc runner 216 to the left series 194 of splitter plates. At the same time, an arc moves up the arc runner 218 to the right series 196 of splitter plates.

To promote upward movement of an electrical arc along the arc runners 216 and 218 on the stationary contact arms 96 and 106 into the left and right series 194 and 196 of splitter plates, the arc runners slope upward and sideward relative to the splitter plates. Thus, the arc runner 218 (FIG. 3) slopes upward and toward the right, as viewed in FIG. 3. In the illustrated embodiment of the invention, the arc runner 218 slopes upward and toward the right at an angle of approximately 45°. Of course the arc runner 218 could slope at a different angle if desired.

The upper end portions 226 and 228 (FIGS. 9 and 3) of the stationary contact arms 96 and 106 extend upward adjacent to and in a spaced apart parallel relationship with splitter plates of the left series 194 of splitter plates and right series 196 of splitter plates. The manner in which the upper end portion 228 of the right stationary contact 106 extends upward to a location spaced from and parallel to splitter plates in the right series 196 of splitter plates is illustrated in FIG. 3. The upper end portion 226 of the left stationary contact arm 96 extends upward in a spaced apart and parallel relationship with splitter plates of the left series 194 in the same manner as illustrated in FIG. 3 for the right stationary contact arm 106.

Upon operation of the current limiting switch assembly 80 from the closed condition shown in solid lines in FIG. 3 to the open condition shown in dashed lines in FIG. 3, an electrical arc moves upward along the arc runner 218 on the stationary contact arm 106 into the splitter plates of the right series 196 of splitter plates. Simultaneously therewith, the arc moves upward along the arc runner 212 on the movable contact arm 212 into the splitter plates of the right series 196 of splitter plates. At the same time, an arc can move upward along the arc runner 216 (FIG. 9) on the stationary contact arm 96 and along the arc runner 210 (FIG. 11) on the movable contact arm 100 into the left series 194 (FIG. 1) of splitter plates.

The separate left and right series 194 and 196 (FIG. 1) of splitter plates extend parallel to and are disposed adjacent to the path of movement of the movable contact arms 100 and 110. By providing two separate, electrically isolated, series 194 and 196 of splitter plates adjacent to the paths of movement of the upper end portions of the movable contact arms 100 and 110, electrical arcing can be conducted to the two series of splitter plates from both of the movable contact arms 100 and 110 as the contact arms move to their open condition. Therefore, upon operation of the current limiting switch assembly 80 from the closed condition to the open condition, electrical arcing between the fixed contacts 94 and 104 and the movable contacts 98 and 108 is moved upward along the arc runners 210, 212, 216, and 218 to the left series 194 and right series 196 of splitter plates in the splitter plate assembly 184. It should be understood that the splitter plate assemblies 186 and 188 have the same construction as the splitter plate assembly 184 and receive electrical arcing in the same manner as the splitter plate assembly 184.

Bypass Circuit

Figure 19:
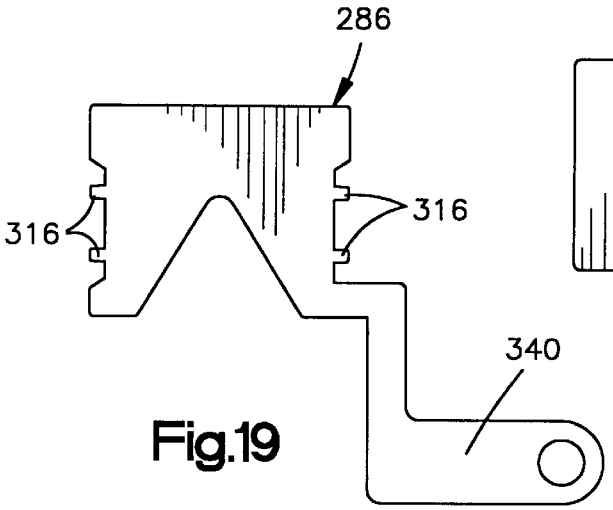
FIG. 19 is a plan view of the bypass splitter plate of FIG. 6.

In accordance with another feature of the invention, a bypass splitter plate 286 (FIGS. 1, 6 and 19) is connected in the bypass circuit 76 (FIG. 1). As was previously mentioned, the bypass circuit 76 conducts excessive current flow around the motor starter 50. Assuming the direction of current flow indicated by the arrows 68, 70 and 72 in FIG. 1, excessive current flow is conducted through the bypass circuit 76 in the direction of the arrow 288 to the bypass splitter plate 286. This current is conducted around the motor starter 50 and does not pass through the motor starter.

Since the bypass splitter plate 286 is at substantially the same potential as the power line 64, electrical arcing will tend to be established between the bypass splitter plate 286 and the upper part 226 of stationary contact arm 96 (FIGS. 1 and 8) in the left set 88 of fixed contacts. Electrical arcing will tend to be extinguished between upper part 228 of stationary contact arm 106 and the bypass splitter plate 286 in the right set 90 of contacts upon initiation of excessive current flow and operation of the current limiting switch assembly 80 from the closed condition toward the open condition. When the arcing is extinguished at the right set 90 of contacts, the flow of electrical current through the motor starter 50 is interrupted. This minimizes the possibility of damage to the contacts of contactor 52 and the thermal elements of overload relay 54 of the motor starter 50.

Upon initiation of excessive current flow to the electric motor 42 (FIG. 1), the current limiting switch assemblies 80, 82 and 84 immediately operate from the closed condition toward the open condition. In the current limiting switch assembly 80, electrical current conducted through the main circuit 44 and motor starter 50 must flow through electrical arcing at the left series 194 of splitter plates to the movable contact arm 100. This current must then flow through the connector section 114 to the right movable contact arm 110. The excessive current flow in the main circuit 44 will then pass through the arc at part of the right series 196 and all of the left series 194 of splitter plates to the stationary contact arm 96 and motor 42. The large majority of the excessive current flow is conducted around the motor starter 50 through the bypass circuit 76 to the motor 42 to protect the motor starter.

The foregoing description of current flow in the main circuit 44 and bypass circuit 76 has assumed a current flow direction indicated by arrows 70 and 288 in FIG. 1. As was previous mentioned, the power lines 64 and 66 are connected with a source of alternating potential. Therefore, at any given time, the direction of current flow may be opposite from the assumed direction of the current flow indicated by the arrows 70 and 288 in FIG. 1. It should be understood that the current limiting switch assemblies 82 and 84 have the same construction as the current limiting switch assembly 80 and bypass excessive current flow in the same manner as the current limiting switch assembly 80.

Splitter Plates

Figure 7:
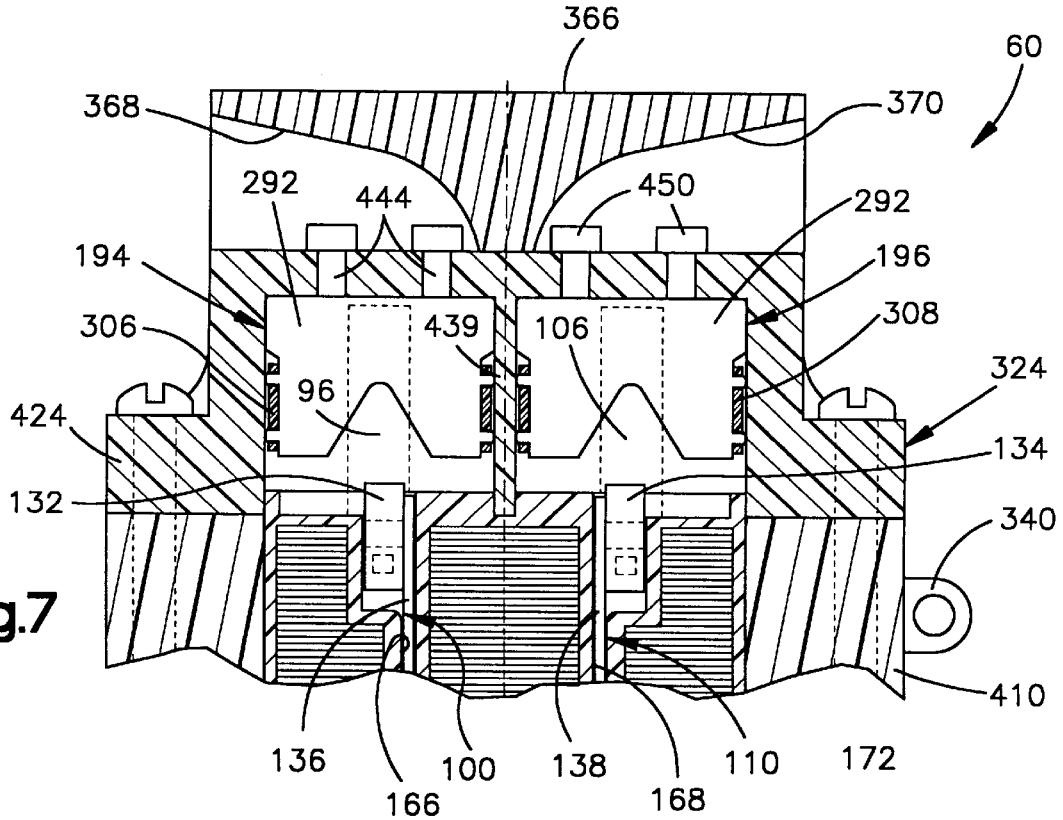
FIG. 7 is a fragmentary sectional view, taken generally along the line 7—7 of FIG. 2, illustrating short splitter plates in the one splitter plate assembly.
Figure 18:
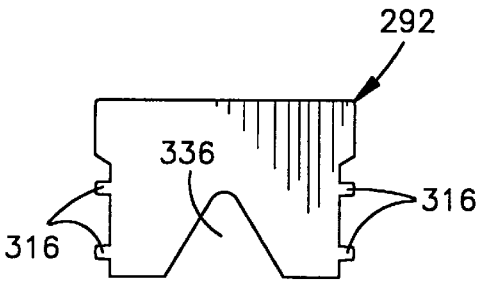
FIG. 18 is a plan view of one of the short splitter plates of FIG. 7.

There are four different splitter plates used in the left and right series 194 and 196 of splitter plates in the splitter plate assembly 184. These four splitter plates include a short splitter plate 292 (FIGS. 7 and 18). The short splitter plates 292 are positioned adjacent to the stationary contact arms 96 and 106 (FIGS. 1 and 3) in the left series 194 of splitter plates and the right series 196 of splitter plates. The short splitter plates 292 provide clearance between the arc runners 216 (FIG. 9) and 218 (FIG. 3) on the stationary contacts 96 and 106. This clearance inhibits the accumulation of particles which could electrically connect the stationary contacts 96 and 106 with the splitter plate assembly 184.

Figure 17:
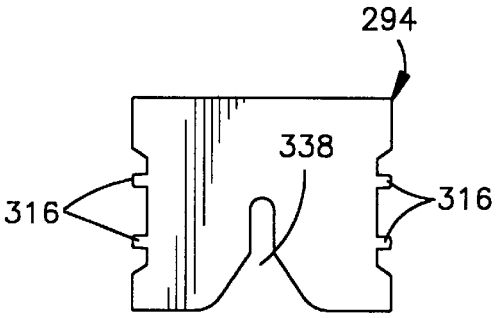
FIG. 17 is a plan view of one of the long splitter plates of FIG. 5.

Long splitter plates 294 (FIGS. 5 and 17) are positioned in the left series 194 and right series 196 (FIG. 1) of the splitter plates at locations along the path of movement of the movable contact arms 100 and 110 as they move from their closed positions toward their open positions. The long splitter plates 294 extend downward (as viewed in FIGS. 3 and 5) toward the paths of movement of the movable contact arms 100 and 110. This promotes the maintaining of movement of an electrical arc into either the left series 194 or right series 196 of splitter plates.

The bypass splitter plate 286 (FIGS. 6 and 19) is disposed only in the right series 196 of splitter plates. By having a bypass splitter plate 286 in only the right series 196 of splitter plates (FIG. 6), electrical arcing tends to be extinguished in the left series 194 of splitter plates. This quickly interrupts a flow of excessive current through the motor starter 50 (FIG. 1).

Figure 20:
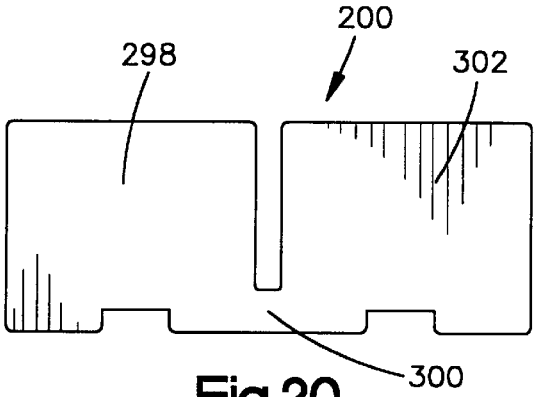
FIG. 20 is a plan view of the common splitter plate of FIG. 4.

A common or short circuit splitter plate 200 (FIGS. 4 and 20) is positioned adjacent to the end of the left series 194 of splitter plates and adjacent to the end of the right series of splitter plates 196. When the current limiting switch assembly closely approaches the open condition, arcing can occur between the movable contact arms 100 and 110 and the common or short circuit splitter plate 200. The current commutates from movable contact arms 100–110 to the short circuit splitter plate 200, removing the arc from the movable contact member.

Figure 21:
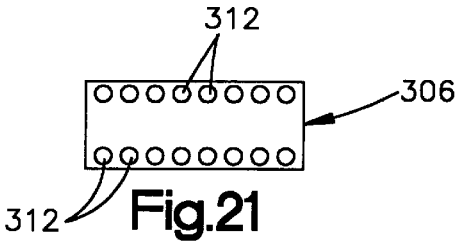
FIG. 21 is a plan view of one of a pair mounting plates which hold the splitter plates of FIGS. 17, 18 and 19 in one of the splitter plate assemblies of FIG. 3.
Figure 22:
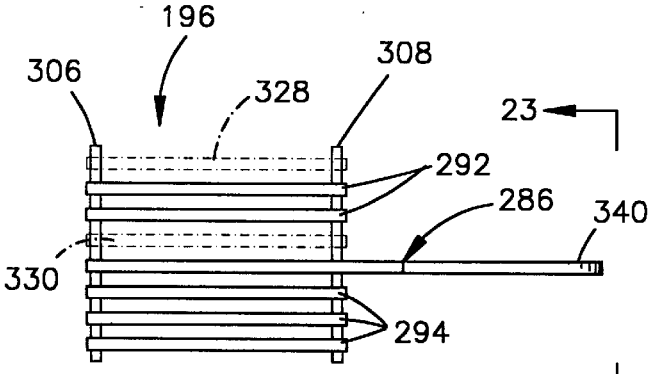
FIG. 22 is a top plan view of a portion of a splitter plate assembly which includes the splitter plates of FIGS. 17, 18 and 19 and a pair of mounting plates of FIG. 21.
Figure 23:
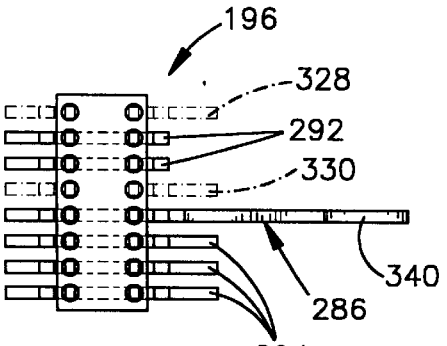
FIG. 23 a side elevational view, taken generally along the line 23—23 of FIG. 22, further illustrating the relationship of the splitter plates to one of the mounting plates.

The short splitter plates 292 (FIGS. 7 and 18), long splitter plates 294 (FIGS. 5 and 17) and bypass splitter plate 286 (FIGS. 6 and 19) are all mounted on a pair of identical mounting plates 306 and 308 formed of an electrically insulating material (FIGS. 21, 22 and 23). The parallel mounting plates 306 and 308 have a plurality of openings 312 (FIG. 21) which are disposed in linear arrays along opposite longitudinally extending edge portions of the rectangular mounting plates. The splitter plates 286, 292 and 294 have mounting tabs or ears 316 (FIGS. 17, 18 and 19) which are received in the openings 312 (FIG. 21) in the mounting plates 306 and 308 (FIG. 22). The mounting tabs 316 extend through the openings 312 (FIG. 21) in the parallel mounting plates 306 and 308 to hold the splitter plates 286, 292 and 294 in a spaced apart parallel relationship (FIGS. 22 and 23).

The right series 196 of splitter plates is mounted in a current limiting switch assembly housing 324 (FIGS. 3 and 4). Flat major side surfaces of the splitter plates 286, 292 and 294 are spaced apart. The flat major side surfaces of the splitter plates extend parallel to and are spaced apart from a flat major side surface of the upper end portion 228 (FIG. 3) of the stationary contact arm 106. The stationary contact arm 106 extends along the right (as viewed in FIG. 2) end of the right series 196 of splitter plates.

Since the bypass splitter plate 286 (FIGS. 6 and 19) is disposed in the right series 196 of splitter plates, it is desirable to avoid any possibility of shorting out of the stationary contact arm 106 (FIG. 3) to the bypass splitter plate 186. When contactor 52 is open and shorting out the stationary contact arm 106 to the bypass splitter plate 286 has occurred, there would be a direct electrically conductive path from the power line 64 (FIG. 1) through the bypass splitter plate 286 to the stationary contact arm 106 and the motor 42. To avoid even the remote possibility of a shorting out occurring, two splitter plates have been omitted in right series 196 of splitter plates. Thus, at locations 328 and 330, indicated by dashed lines in FIG. 22, splitter plates have been omitted from the right series 196 of splitter plates.

Omission of the splitter plate at the location indicated in dashed lines at 328 in FIG. 22 provides a relatively wide space between the upper end portion 228 (FIG. 3) of the stationary contact arm 106 and the first splitter plate in the right series 196 of splitter plates. Omission of a splitter plate at the location indicated in dashed lines at 330 (FIG. 2) provides a relatively large gap adjacent to the bypass splitter plate 286 (FIGS. 22 and 23). Therefore, there is almost no possibility of particles of material accumulating in such a manner as to short out the bypass splitter plate 286 with the stationary contact arm 106.

In addition to the bypass circuit plate 286, the right series of splitter plates 196 includes a pair of short splitter plates 292 (FIGS. 7, 18, 22 and 23). The short splitter plates 292 have a relatively large, generally V-shaped opening 336 (FIG. 18) which can accommodate the head end portion 134 (FIGS. 7 and 10) of the movable contact arm 110 (FIG. 3). The two short splitter plates 292 in the right series of splitter plates extend parallel to each other and to the bypass splitter plate 286. Since the short splitter plates 292 have lower edges which are spaced from the movable contact arm 110, the possibility of accumulation of particles on the short splitter plates is minimized.

Figure 5:
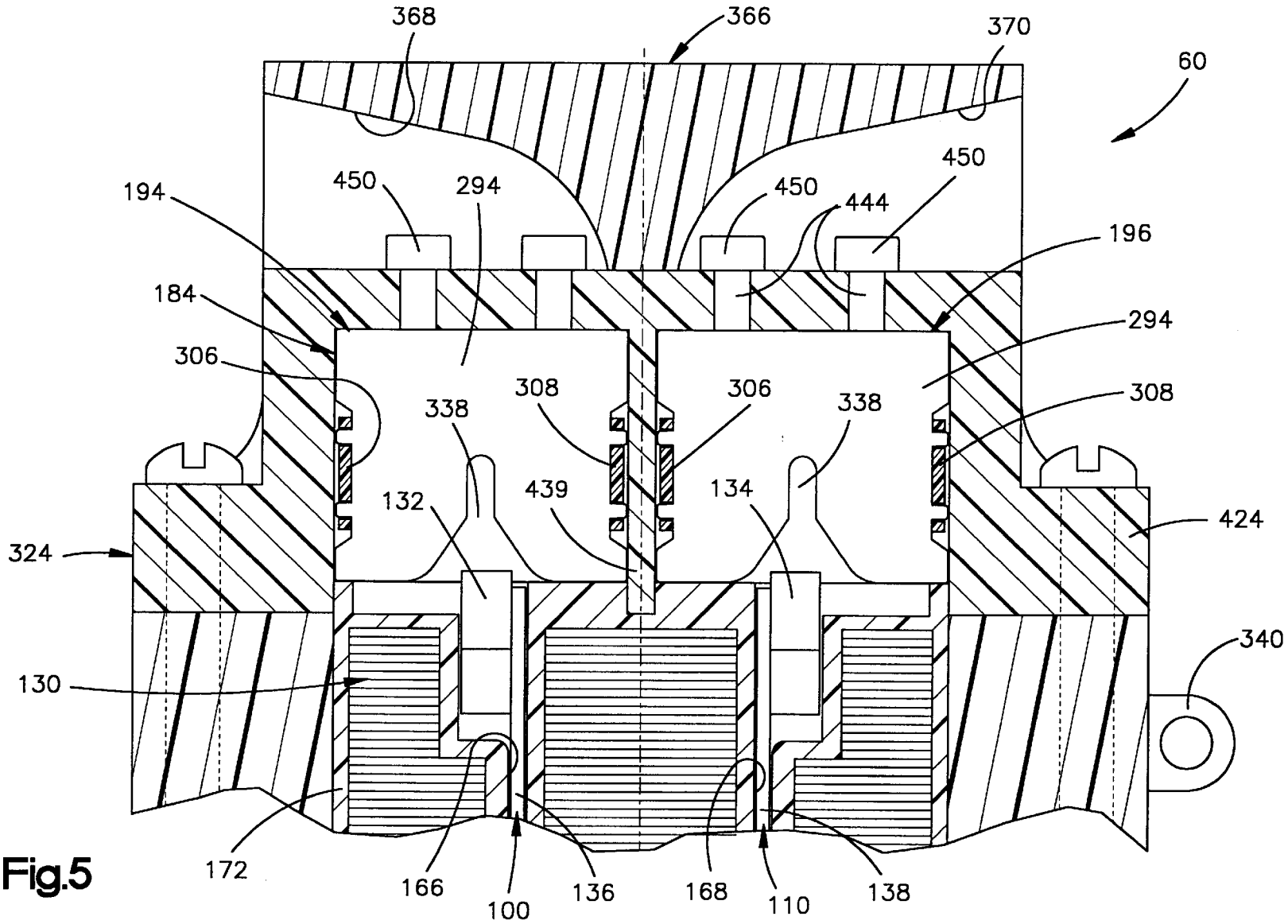
FIG. 5 is a fragmentary sectional view, taken generally along the line 5—5 of FIG. 3, illustrating a pair of long splitter plates in the one splitter plate assembly.

A plurality of long splitter plates 294 (FIGS. 5 and 17) complete the right series 196 of splitter plates (FIGS. 22 and 23). The relatively long splitter plates 294 extend downward toward the path of movement of the right movable contact arm 110 (FIGS. 3 and 5). The long splitter plates 294 encourage movement of arcing from the arc runner 212 on the movable contact arm 110 upward to the right series 196 of splitter plates. The long splitter plate 294 has a relatively small central opening 338 (FIG. 17) through which the movable contact arm 110 (FIG. 5) moves. The short splitter plate 292 (FIGS. 7 and 18) has a larger opening through which the contact arm 110 (FIG. 3) moves. This results in the long splitter plates 294 being relatively close to the movable contact arm 110 (FIG. 5) to promote transfer of electrical arcing from the movable contact arm to the long splitter plates 294.

The bypass splitter plate 286 is relatively long. The bypass splitter plate has a bypass arm 340 (FIGS. 6 and 19) which extends outward from the bypass splitter plate 286 and is connected in the bypass circuit 76 (FIG. 1).

Figure 6:
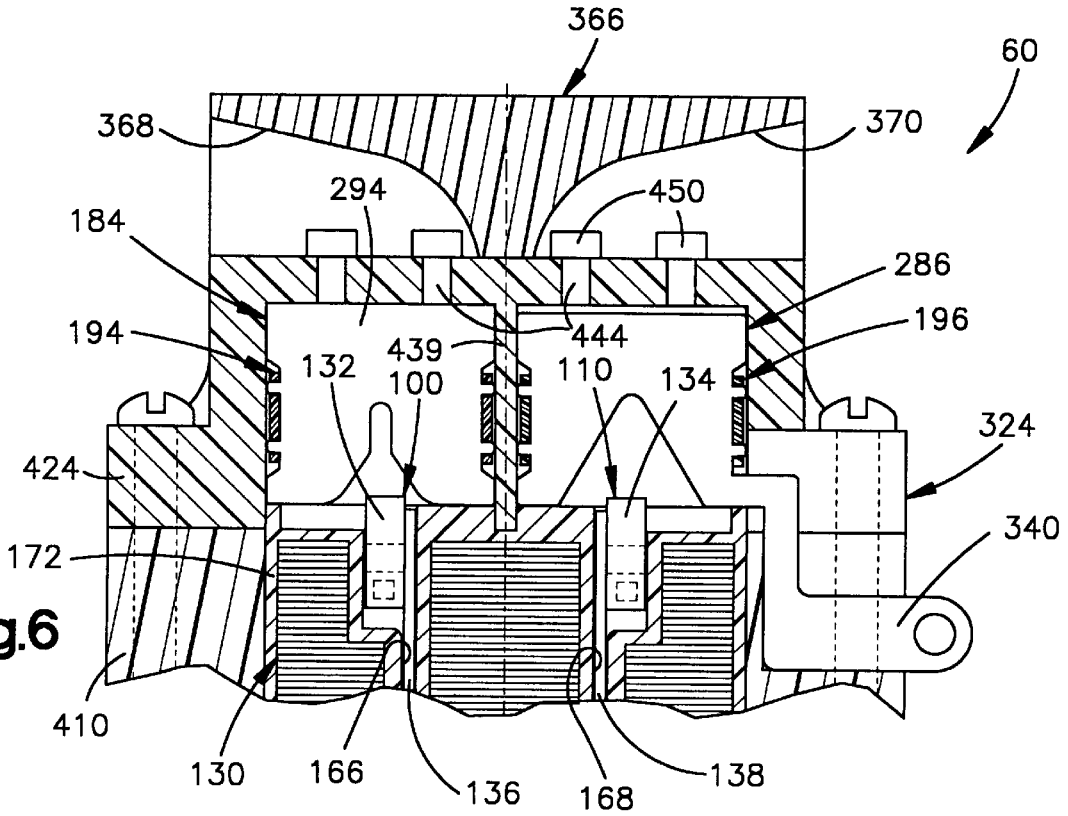
FIG. 6 is a fragmentary sectional view, taken generally along the line 6—6 of FIG. 2, illustrating a bypass splitter plate and a long splitter plate in the one splitter plate assembly.

The left series 194 of splitter plates does not include a bypass splitter plate. The left series of splitter plates 194 includes two short splitter plates 292 (FIG. 7) which are mounted at the end of the left series of splitter plates 194 adjacent to the stationary contact arm 96 and six long splitter plates 294 (FIGS. 5 and 6). The two short splitter plates 292 and six long splitter plates 294 are mounted in the openings 312 in a pair of mounting plates, corresponding to the mounting plates 306 and 308 of FIGS. 21–23.

Although it is preferred to provide a bypass circuit 76, it is contemplated that the bypass circuit and bypass splitter plate 286 could be omitted. If this was done, the right series of splitter plates 196 would have the same construction as the left series of splitter plates. Thus, if the bypass splitter plate 286 was omitted from the right series of splitter plates, the right series of splitter plates would include a pair of short splitter plates 292 adjacent to the stationary contact arm 106 to accommodate the arc runner 218 (FIG. 3) and six long splitter plates 294. If the bypass circuit 76 and bypass splitter plate 286 are omitted, the electric current control apparatus 60 (FIG. 1) would protect the motor starter 50 by opening the main circuit 44 upon initiation of excessive current flow to the electric motor 42.

The common splitter plate 200 (FIGS. 4 and 20) is mounted in a recess (326 (FIG. 3) in the housing 324 at the ends of the left series 194 of splitter plates and the right series 196 of splitter plates. The section 298 (FIG. 20) of the common splitter plate 200 is aligned with the left series 194 of splitter plates. The section 302 of the common splitter plate 200 is aligned with the right series 196 of splitter plates.

Hot Gas Flow

During operation of the current limiting switch assembly 80 from the closed condition to the open condition, arcing will occur between the stationary contact arms 96 and 106 and movable contact arms 100 and 110 and the splitter plate assembly 184. As this arcing occurs, hot gases are generated.

In accordance with a feature of the present invention, slot filler members 360 (FIG. 3) are provided in the slots 166 and 168 (FIG. 4) in the lower portion of the stack 130 of laminations. The slot filler members 360 fill the relatively large portions 162 (FIG. 13) of the slots in the lower laminations 148 through which the head end portions 132 and 134 (FIG. 4) of the U-shaped movable contactor 118 are inserted.

By blocking the lower end portions of the slots 166 and 168 with the slot filler members 360, the flow of hot gases out of the lower (as viewed in FIG. 4) end portion of the slots 166 and 168 is mostly blocked. This results in the hot gases associated with electrical arcing moving upward toward the splitter plate assembly 184. The upward flow of hot gases into the splitter plate assembly 184 promotes movement of the electrical arcing between the stationary contact arms 96 and 106 and movable contact arms 100 and 110 moving upward into the splitter plate assembly. Although the slot filler members 360 have been illustrated in FIG. 4 in association with only the current limiting switch assembly 80, it should be understood that slot filler members 360 are also associated with the current limiting switch assemblies 82 and 84 (FIG. 3).

In accordance with another feature of the invention, a deflector 366 is mounted on the upper portion of the housing 324 (FIG. 4). The deflector 366 has arcuately curving deflector surfaces 368 and 370 which deflect hot gases in opposite directions from the housing 324. Thus, hot gases associated with the left series 194 of splitter plates are directed toward the left by the arcuate deflector surfaces 368 (FIGS. 4, 5, 6 and 7). Hot gases associated with the right series 196 of splitter plates are directed toward the right by the arcuate deflector surface 370. By promoting an upward flow of hot gases toward the deflector surfaces 368 and 370, downward movement of electrical arcing into the lower portion of the housing 324 is avoided.

Housing

The housing 324 includes a rectangular base 380 (FIG. 4). Leads 384 and 386 (FIG. 1) for the current limiting switch assembly 80 are connected with the stationary contact arms 96 and 106 at terminals 388 and 390 on the base 280 (FIG. 4). Terminals for the current limiting switch assemblies 82 and 84 are also provided on the base 380. Thus, terminals 392 and 394 (FIG. 2) are provided on the base 380 for connection with main circuit leads connected to the current limiting switch assembly 82. Terminals 396 and 398 are provided on the base 380 to connect leads with the current limiting switch assembly 84.

A rectangular spring mounting plate 404 is mounted on the base 380 (FIG. 4). The spring mounting plate 404 has projections 406 (FIG. 3) on which the springs 122 for the U-shaped movable contactor 118 of the current limiting switch assembly 80. In addition, the spring mounting plate 404 has projections 406 to mount springs for the current limiting switch assemblies 82 and 84.

A rectangular body section 410 (FIGS. 3 and 4) of the housing 324 extends upward from the base 380. The body section 410 is connected with the base 380 of the housing 324 by fasteners 414 (FIG. 2). The body section 410 of the housing has a rectangular central recess 418 (FIG. 4) in which the lamination housing 172 and block 130 of laminations are received.

Figure 24:
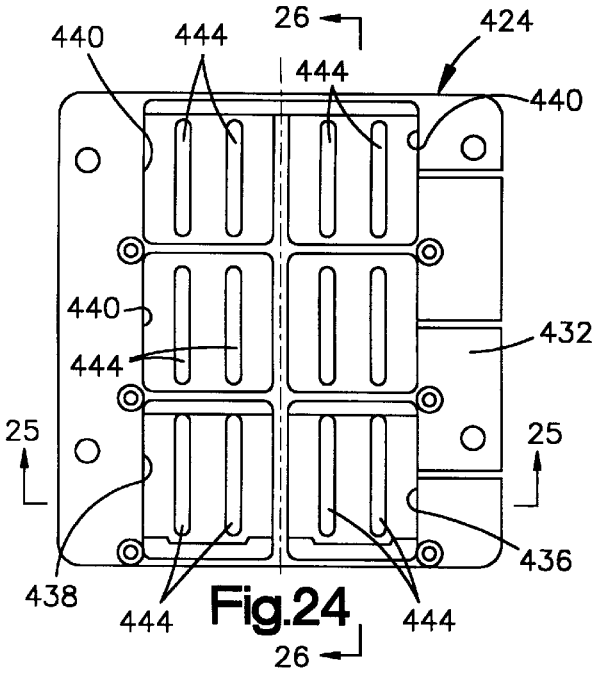
FIG. 24 a bottom plan view of an upper end or cap portion of a housing in the electrical current control apparatus of FIG. 2.
Figure 25:
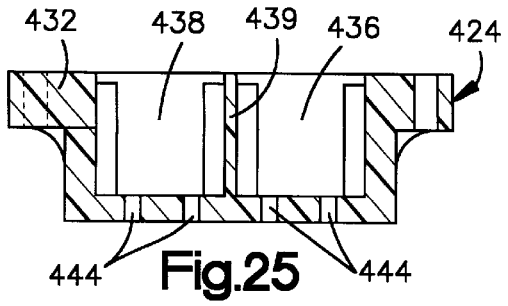
FIG. 25 is a sectional view, taken generally along the line 25—25 of FIG. 24, further illustrating the construction of the cap portion of the housing.
Figure 26:
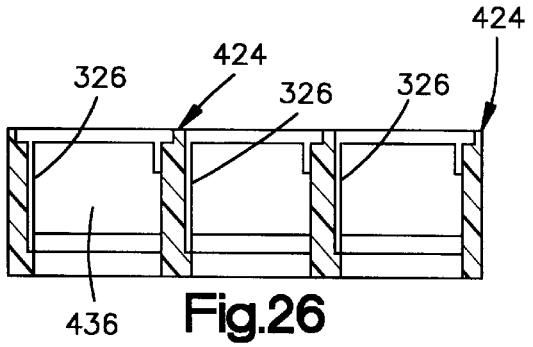
FIG. 26 is a fragmentary sectional view, taken generally along the line 26—26 of FIG. 24, further illustrating the construction of the cap portion of the housing.

An upper end section 424 (FIGS. 4, 24, 25 and 26) of the housing 324 is connected with the body section 410 of the housing by fasteners 428 (FIG. 2). A lower side surface 432 of the upper end section 424 of the housing is illustrated in FIG. 24. A rectangular recess 436 is provided to receive the left series 194 of splitter plates. A second recess 438 is provided to receive the right series 194 of splitter plates. A wall or body 439 (FIG. 25) of electrically insulating material is disposed between the recesses 436 and 438. The wall 436 extends into engagement with the lamination housing 172 (FIGS. 5, 6 and 7) and separates the left and right series 194 and 196 of splitter plates.

Similarly, recesses 440 (FIG. 24) are provided to receive the splitter plate assemblies 186 and 188 (FIG. 3) for the current limiting switch assemblies 82 and 84. A plurality of slots 444 are provided in an upper wall of the upper end section 424 to enable hot gases associated with electrical arcing to move upward from the splitter plate assemblies 184, 186 and 188 to the deflector 366.

Figure 27:
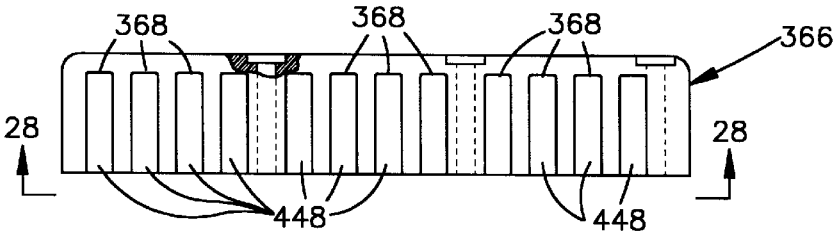
FIG. 27 is a side elevational view of a deflector which forms a portion of the housing for the electric current control/apparatus.
Figure 28:
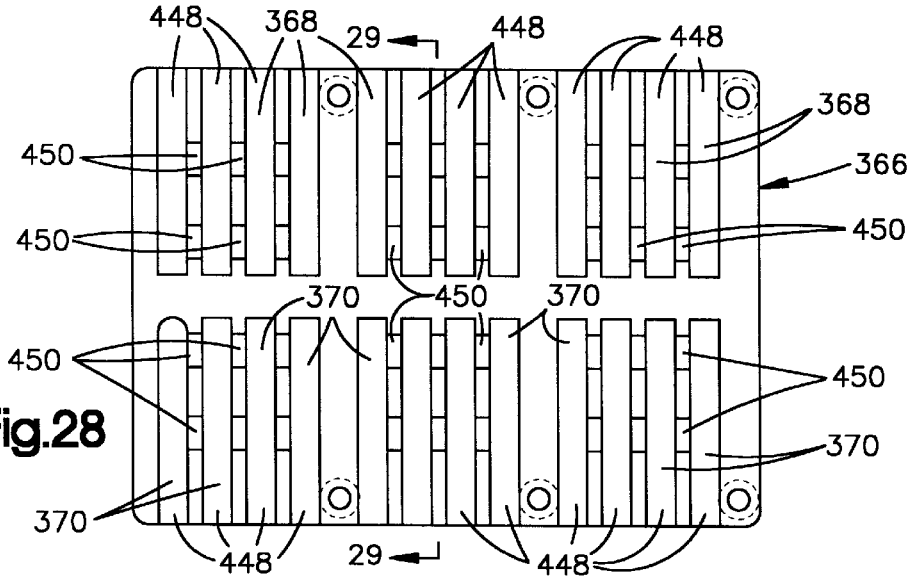
FIG. 28 is a bottom plan view, taken generally along the line 28—28 of FIG. 27, further illustrating the construction of the deflector.
Figure 29:
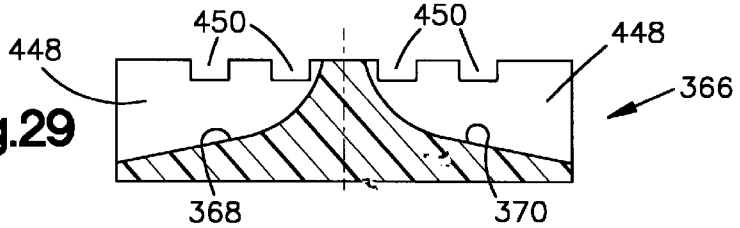
FIG. 29 is a fragmentary sectional view, taken generally along the line 29—29 of FIG. 28, further illustrating the construction of the deflector.

The deflector 366 is fixedly connected to the upper end section 424 of the housing 324 by suitable fasteners. The deflector 366 (FIG. 27) includes a plurality of slots on which the deflector surfaces 368 and 370 (FIGS. 28 and 29) are formed. The slots 448 are interconnected by cross slots 450.

Operation

During normal operation of the electric motor 42 (FIG. 1), electrical current is conducted between the power lines 64 and 66 through the electric current control apparatus 60. The electric current control apparatus 60 includes three current limiting switch assemblies 80, 82 and 84, that is, one current limiting switch assembly for each of the three phases of the electrical current conducted to the motor 42. At this time, the left and right sets of contacts 88 and 90 in the current limiting switch assemblies 80, 82 and 84 are closed so that current is conducted from the power line 64 through the motor starter 50 to the motor 42 for each of the phases of the motor 42.

Upon initiation of a flow of excessive current to the motor 42, due to a malfunctioning of the motor, magnetic fields emanating from oppositely flowing currents in the current limiting switch assemblies 80, 82 and 84 effect operation of the current limiting switch assemblies from the closed condition to the open condition. In the current limiting switch assembly 80, current is conducted upward in the stationary contact arm 106 and downward in the movable contact arm 110. Similarly, current is conducted upward in the movable contact arm 100 and downward in the stationary contact arm 96.

Upon initiation of excessive current flow to the electric motor 42, the increased current results in the magnetic fields emanating from the oppositely flowing currents increasing in strength. This increases repulsion forces between the movable contact arms 100 and 110 and the stationary contact arms 96 and 106. These magnetic repulsion forces cause the movable contact arms 100 and 110 to move away from the stationary contact arms 96 and 106 to open the current limiting switch assembly 80.

In accordance with a feature of the present invention, the magnetic fields emanating from the oppositely flowing currents in the three current limiting switch assemblies 80, 82 and 84 (FIG. 3) are concentrated by the single stack 130 of laminations. The stack 130 of laminations extends around portions of each of the current limiting switch assemblies 80, 82 and 84. Thus, stationary contact arms 96 and 106 and movable contact arms 100 and 110 for the current limiting switch assembly 80 extend through slots 166 and 168 (FIG. 4) in the stack 130 of laminations. Similarly, stationary movable contact arms for the current limiting switch assemblies 82 and 84 extend through slots in the stack 130 of laminations.

Splitter plate assemblies 184, 186 and 188 are provided in association with the current limiting switch assemblies 80, 82 and 84 (FIG. 3). The splitter plate assembly 184 includes a left series 194 (FIGS. 1, 5, 6, and 7) of splitter plates and a right series 196 of splitter plates. A common splitter plate 200 (FIG. 4) extends along one end of the left and right series 194 and 196 of splitter plates. The right series of splitter plates 196 includes a bypass splitter plate 286 which is connected in a bypass circuit 76.

Upon initiation of a flow of excessive current, the current limiting switch assembly 80 is quickly actuated from the closed condition to the open condition. As the current limiting switch assembly 80 is opened, electrical arcing is conducted from the stationary contact arms 96 and 106 and movable contact arms 100 and 110 into the left series 194 and right series 196 (FIG. 1) of splitter plates. At this time, electrical current is bypassed around the motor starter 50 through the bypass circuit 76 which is connected with the bypass splitter plate 286.

Upon movement of the movable contact arms 100 and 110 to their open positions, the electrical arcing extends to the common splitter plate 200. This results in electrical current being commutated from the movable contact to the short circuit splitter plate 200. Also, current is commutated to the bypass splitter plate 286.

The current limiting switch assemblies 82 and 84 are also operated from their closed conditions to their open conditions upon initiation of excessive current flow. Operation of the current limiting switch assemblies 80, 82 and 84 protects all three phases of the electric motor 42. The current limiting switch assemblies 80, 82 and 84 all have the same construction and mode of operation. The apparatus 60 is also effective to interrupt harmful current to the starter 50 without the bypass circuit.

Conclusion

A control apparatus 40 for a device, such as an electric motor 42, include an electric current control apparatus 60. The electric current control apparatus 60 may include two sets 88 and 90 of contacts. One contact in each set 88 and 90 of contacts is mounted on a movable contact arm 100 and 110. The movable contact arms 100 and 110 may be movable under the influence of opposition between magnetic fields.

The movable contact arms 100 and 110 are advantageously movable along slots 166 and 168 disposed in a stack 130 of laminations 128. The laminations 128 concentrate magnetic fields emanating from electric current conducted through the movable contact arms 100 and 110. When the control apparatus 40 is utilized with a three-phase electric motor 42, the electric current control apparatus 60 may include three current limiting switch assemblies 80, 82 and 84 having contact arms 100 and 110 which are movable in slots 166 and 168 formed in a single stack 130 of laminations 128.

In one embodiment of the invention, a first series of splitter plates is disposed along the path of movement of one of the contact arms 100 in a current limiting switch assembly 80. A second series of splitter plates 196 is disposed along the path of movement of a second contact arm 110 in the current limiting switch assembly 80. The splitter plates 194 and 196 receive electrical arcing upon operation of the current limiting switch assembly 80 from a closed condition to an open condition.

One of the splitter plates 286 may be connected in a bypass circuit 76 which protects a device, such as a motor starter 50, by conducting excessive current flow around the device. A common splitter plate may be provided to conduct current directly between the two series 194 and 196 of splitter plates rather than through the movable contact. During operation of contacts 88 and 90 from a closed condition to an open condition, hot gases associated with electrical arcing are directed toward the splitter plates 194 and 196 by at least partially blocking ends of the slots 166 and 168 in the stack 130 of laminations.

Having described the invention, the following is claimed:

1. An electric control apparatus comprising first and second sets of contacts, a first conductor connected with a first contact in said first set of contacts, a second conductor which is movable relative to said first conductor and is connected with a second contact in said first set of contacts, said first and second conductors being disposed adjacent to each other and being effective to conduct electrical current in opposite directions when said second conductor is in an initial position in which said first contact engages said second contact, a third conductor connected with a first contact in said second set of contacts, a fourth conductor which is movable relative to said third conductor and is connected with a second contact in said second set of contacts, said third and fourth conductors being disposed adjacent to each other and being effective to conduct electrical current in opposite directions when said fourth conductor is in an initial position in which said first contact in said second set of contacts engages said second contact in said second set of contacts, said second and fourth conductors being movable relative to said first and third conductors under the influence of opposition between magnetic fields emanating from electrical current conducted through said first, second, third and fourth conductors, a plurality of laminations formed of a magnetizable material and disposed in a stack of laminations, said stack of laminations including surface means for defining first and second slots, said second conductor being at least partially disposed in and movable along said first slot in said stack of laminations to enable said stack of laminations to concentrate a magnetic field emanating from said second conductor during movement of said second conductor relative to said first conductor, said fourth conductor being at least partially disposed in and movable along said second slot in said stack of laminations to enable said stack of laminations to concentrate a magnetic field emanating from said fourth conductor during movement of said fourth conductor relative to said third conductor, and connector means extending between said second and fourth conductors for conducting electrical current between said second and fourth conductors and for transmitting force between said second and fourth conductors so that said second and fourth conductors move together relative to said stack of laminations.

2. An apparatus as set forth in claim 1 further including a first series of splitter plates disposed in an array along a path of movement of said second conductor relative to said first conductor to receive electrical arcing upon movement of said second contact in said first set of contacts out of engagement with said first contact in said first set of contacts, and a second series of splitter plates disposed in an array along a path of movement of said fourth conductor relative to said third conductor to receive electrical arcing upon movement of said second contact in said second set of contacts out of engagement with said first contact in said second set of contacts.

3. An apparatus as set forth in claim 2 further including a first body of electrically insulating material at least partially disposed in said first slot in said stack of laminations to retard gas flow through said first slot in a direction away from said first series of splitter plates, and a second body of electrically insulating material at least partially disposed in said second slot in said stack of laminations to retard gas flow through said second slot in a direction away from said second series of splitter plates.

4. An apparatus as set forth in claim 2 further including a short circuit splitter plate for conducting electrical energy between said first and second series of splitter plates, said short circuit splitter plate including a first section which is aligned with said first series of splitter plates, a second section which is aligned with said second series of splitter plates, and an electrical conductor connected with said first and second sections of said short circuit splitter plate to enable electrical current to be conducted between said first and second sections of said short circuit splitter plate.

5. An apparatus as set forth in claim 2 wherein one of said splitter plates in said first series of splitter plates is connected with a bypass circuit which conducts electrical current during movement of said second conductor relative to said first conductor.

6. An apparatus as set forth in claim 1 wherein said first conductor is at least partially disposed in said first slot in said stack of laminations and said third conductor is at least partially disposed in said second slot in said stack of laminations to enable said stack of laminations to concentrate magnetic fields emanating from said first and third conductors during flow of current through said first and third conductors.

7. An apparatus as set forth in claim 1 wherein said second conductor has a head end portion which is at least partially disposed in said first slot and has a first width in a direction transverse to a path of movement of said second conductor along said first slot, said second contact of said first set of contacts being disposed on said head end portion of said second conductor, said second conductor having a body portion which is at least partially disposed in said first slot and has a second width in a direction transverse to the path of movement of said second conductor along said first slot, said second width being smaller than said first width, said first slot having a first portion along which said head end portion of said second conductor moves and a second portion along which said body portion of said second conductor moves, said first portion of said first slot being wider than said second portion of said first slot, said fourth conductor having a head end portion which is at least partially disposed in said second slot and has a third width in a direction transverse to a path of movement of said fourth conductor along said second slot, said second contact of said second set of contacts being disposed on said head end portion of said fourth conductor, said fourth conductor having a body portion which is at least partially disposed in said second slot and has a fourth width in a direction transverse to the path of movement of said fourth conductor along said second slot, said fourth width being smaller than said third width, said second slot having a first portion along which said head end portion of said fourth conductor moves and a second portion along which said body portion of said fourth conductor moves, said first portion of said second slot being wider than said second portion of said second slot.

8. An apparatus as set forth in claim 1 wherein said first and second contacts in said first set of contacts are disposed in said first slot in said stack of laminations and said first and second contacts in said second set of contacts are disposed in said second slot in said stack of laminations.

9. An apparatus as set forth in claim 1 further including spring means for applying force against said connector means to urge said second and fourth conductors toward said first and third conductors.

10. An electric control apparatus comprising first and second sets of contacts, a first conductor connected with a first contact in said first set of contacts, a second conductor which is movable relative to said first conductor and is connected with a second contact in said first set of contacts, a third conductor connected with a first contact in said second set of contacts, a fourth conductor which is movable relative to said third conductor and is connected with a second contact in said second set of contacts, said second and fourth conductors being movable relative to said first and third conductors, a plurality of laminations formed of a magnetizable material and disposed in a stack of laminations, said stack of laminations including surface means for defining first and second slots, said second conductor being at least partially disposed in and movable along said first slot in said stack of laminations, said fourth conductor being at least partially disposed in and movable along said second slot in said stack of laminations, a first series of splitter plates disposed in an array along a path of movement of said second conductor in said first slot in said stack of laminations to receive electrical arcing upon movement of said second conductor along said first slot in said stack of laminations, and a second series of splitter plates disposed in an array along a path of movement of said fourth conductor in said second slot in said stack of laminations to receive electrical arcing upon movement of said fourth conductor along said second slot in said stack of laminations.

11. An apparatus as set forth in claim 10 wherein one of said splitter plates in said first series of splitter plates is connected with a bypass circuit which conducts electrical current during movement of said second conductor relative to said first conductor.

12. An apparatus as set forth in claim 10 further including a short circuit splitter plate for conducting electrical energy between said first and second series of splitter plates, said short circuit splitter plate including a first section which is aligned with said first series of splitter plates, a second section which is aligned with said second series of splitter plates, and an electrical conductor connected with said first and second sections of said short circuit splitter plate to enable electrical energy to be conducted between said first and second sections of said short circuit splitter plate.

13. An electric control apparatus comprising first and second sets of contacts, a first conductor connected with a first contact in said first set of contacts, a second conductor which is movable relative to said first conductor and is connected with a second contact in said first set of contacts, a third conductor connected with a first contact in said second set of contacts, a fourth conductor which is movable relative to said third conductor and is connected with a second contact in said second set of contacts, said second and fourth conductors being movable relative to said first and third conductors, a plurality of laminations formed of a magnetizable material and disposed in a stack of laminations, said stack of laminations including surface means for defining first and second slots, said second conductor being at least partially disposed in and movable along said first slot in said stack of laminations between first and second end portions of said first slot, said fourth conductor being at least partially disposed in and movable along said second slot in said stack of laminations between first and second end portions of said second slot, a first series of splitter plates disposed in an array along said first slot in said stack of laminations to receive electrical arcing upon movement of said second conductor along said first slot in said stack of laminations, a second series of splitter plates disposed in an array along said second slot in said stack of laminations to receive electrical arcing upon movement of said fourth conductor along said second slot in said stack of laminations, electrically insulating material disposed between said first and second series of splitter plates to block conduction of electrical current between said first and second series of splitter plates, and a short circuit splitter plate disposed adjacent to said second end portions of said first and second slots to conduct electrical energy between said first and second series of splitter plates when said second and fourth conductors are adjacent to said second end portions of said first and second slots.

14. An apparatus as set forth in claim 13 wherein said short circuit splitter plate includes a first section which is aligned with said first series of splitter plates and is disposed adjacent to said second end portion of said first slot, a second section which is aligned with said second series of splitter plates and is disposed adjacent to said second end portion of said second slot, and an electrical conductor connected with said first and second sections of said short circuit splitter plate to enable electrical energy to be conducted between said first and second sections of said short circuit splitter plate.

15. An apparatus as set forth in claim 13 wherein one of said splitter plates in said first series of splitter plates is connected with a bypass circuit which conducts electrical current during movement of said movable contact in said first set of contacts along said first operating path.

16. An apparatus as set forth in claim 13 further including a first body of electrically insulating material being disposed in said first slot to retard gas flow associated with electrical arcing at said first series of splitter plates, and a second body of electrically insulating material being disposed in said second slot to retard gas flow associated with electrical arcing at said second series of splitter plates.

17. An electrical apparatus comprising main circuit means for conducting electrical current to an electric motor during normal operation of the electric motor, said main circuit means including a motor starter and a current limiting switch assembly, and bypass circuit means for conducting electrical current around said motor starter upon initiation of a flow of excessive electrical current to the electric motor to protect said motor starter against excessive electrical current flow, said current limiting switch assembly including a first set of contacts, a first conductor connected with a first contact in said first set of contacts, a second conductor which is movable relative to said first conductor and is connected with a second contact in said first set of contacts, said second conductor being movable relative to said first conductor between a closed condition in which said first and second contacts are in engagement and an open condition in which said first and second contacts are spaced apart, a plurality of laminations formed of magnetizable material and disposed in a stack of laminations, said stack of laminations including surface means for defining a first slot, said second conductor being at least partially disposed in and movable along said first slot in said stack of laminations to enable said stack of laminations to concentrate a magnetic field emanating from said second conductor during movement of said second conductor between the open and closed conditions, and a plurality of splitter plates disposed along said first slot for receiving electrical arcing upon movement of said second conductor from the closed condition to the open condition, said plurality of splitter plates including at least one splitter plate which is part of said bypass circuit means.

18. An apparatus as set forth in claim 17 wherein said first conductor has an elongated body portion with a first section which extends in a first direction from said first contact and a second section which extends in a second direction from said first contact, said second conductor having an elongated body portion which extends in the first direction from said second contact and is disposed adjacent to said first section of said elongated body portion of said first conductor when said second conductor is in the closed condition, said second conductor being movable relative to said first conductor under the influence of magnetic fields emanating from electrical current conducted in opposite directions through said first section of said elongated body portion of said first conductor and said elongated body portion of said second conductor to effect movement of said second conductor from the closed condition to the open condition, said second section of said elongated body portion of said first conductor being disposed adjacent to one of said splitter plates to enable an electrical arc to travel along said second section of said elongated body portion of said first conductor toward said one of said splitter plates upon movement of said first conductor from the closed condition to the open condition.

19. An apparatus as set forth in claim 17 wherein said one splitter plate which is part of said bypass circuit means is disposed between a second splitter plate of said plurality of splitter plates and a third splitter plate of said plurality of splitter plates, said third splitter plate of said plurality of splitter plates is disposed further from said one splitter plate of said plurality of splitter than said second splitter plate of said plurality of splitter plates.

20. An apparatus as set forth in claim 17 wherein said motor starter is connected in series with said first set of contacts in said current limiting switch assembly, said one splitter plate of said plurality of splitter plates being connected in parallel with said motor starter by said first set of contacts in said current limiting switch assembly during electrical arcing.

21. An electrical control apparatus comprising a plurality of switch assemblies adapted to be connected with a plurality of phases of an electric motor, said switch assemblies being operable from a closed condition to an open condition, each of said switch assemblies includes a set of contacts, a first conductor connected with a first contact in said set of contacts, a second conductor connected with a second contact in said set of contacts and movable relative to said first conductor and said first contact, and a plurality of laminations formed of a magnetizable material and disposed in a stack of laminations which at least partially defines a plurality of slots, each of said laminations extends around said second conductor in each of said switch assemblies of said plurality of switch assemblies to concentrate magnetic flux emanating from electrical current conducted through said switch assemblies, said second conductor in each of said switch assemblies being movable along one of the slots of said plurality of slots in said stack of laminations.

22. An apparatus as set forth in claim 21 further including a plurality of bodies of electrically insulating material disposed adjacent to first end portions of said slots in said stack of laminations to at least partially block a flow of gas through said slots.

23. An apparatus as set forth in claim 22 further including a plurality of splitter plates formed of an electrically conductive material and disposed adjacent to second end portions of said slots in said stack of laminations to receive electrical arcing between contacts of said plurality of switch assemblies.

24. An apparatus as set forth in claim 21 further including a plurality of groups of splitter plates each of which is disposed adjacent to one of said switch assemblies to receive arcing between contacts of said one of said switch assemblies upon operation of said one of said switch assemblies from the closed condition to the open condition, at least one of said splitter plates in each of said groups of splitter plates including means for connecting said one of said splitter plates with a bypass circuit.

25. An apparatus as set forth in claim 21 wherein said second conductor in each of said switch assemblies includes a head end portion with a first width in a direction transverse to a path of movement of said second conductor and a body portion with a second width in a direction transverse to the path of movement of said movable conductor, said second width being smaller than said first width, said laminations of said plurality of laminations includes a first series of laminations having a plurality of openings in which said head end portions of said movable conductors in said plurality of switch assemblies are at least partially disposed and a second series of laminations having a plurality of openings in which said body portions of said movable conductors in said plurality of switch assemblies are at least partially disposed, said openings in said first series of laminations being larger than said openings in said second series of laminations.

26. An apparatus as set forth in claim 25 further including a plurality of filler members formed of electrically insulating material, each one of said filler members of said plurality of filler members being disposed in an opening in said second series of laminations to at least partially block the openings in said second series of laminations.

27. An electrical apparatus comprising a first switch assembly adapted to be connected with a first phase of an electric motor and operable from a closed condition to an open condition to interrupt a flow of electrical current through said first switch assembly to the first phase of the electric motor, said first switch assembly includes a first stationary conductor through which electrical current is conducted when said first switch assembly is in the closed condition and a first movable conductor which is disposed adjacent to said first stationary conductor and through which electrical current is conducted in a direction opposite to a direction which electrical current is conducted through said first stationary conductor when said first switch assembly is in the closed condition, said first switch assembly being operable from the closed condition to the open condition under the influence of opposition between magnetic fields emanating from said first stationary conductor and said first movable conductor upon initiation of excessive current flow through said first switch assembly, a second switch assembly adapted to be connected with a second phase of the electric motor and operable from a closed condition to an open condition to interrupt a flow of electrical current through said second switch assembly to the second phase of the electric motor, said second switch assembly includes a second stationary conductor through which electrical current is conducted when said second switch assembly is in the closed condition and a second movable conductor which is disposed adjacent to said second stationary conductor and through which electrical current is conducted in a direction opposite to a direction which electrical current is conducted through said second stationary conductor when said second switch assembly is in the closed condition, said second switch assembly being operable from the closed condition to the open condition under the influence of opposition between magnetic fields emanating from said second stationary conductor and said second movable conductor upon initiation of excessive current flow through said second switch assembly, a third switch assembly adapted to be connected with a third phase of the electric motor and operable from a closed condition to an open condition to interrupt a flow of electrical current through said third switch assembly to the third phase of the electric motor, said third switch assembly includes a third stationary conductor through which electrical current is conducted when said third switch assembly is in the closed condition and a third movable conductor which is disposed adjacent to said third stationary conductor and through which electrical current is conducted in a direction opposite to a direction which electrical current is conducted through said third stationary conductor when said third switch assembly is in the closed condition, said third switch assembly being operable from the closed condition to the open condition under the influence of opposition between magnetic fields emanating from said third stationary conductor and said third movable conductor upon initiation of excessive current flow through said third switch assembly, and a plurality of laminations formed of a magnetizable material and disposed in a stack, each of said laminations of said plurality of laminations includes a plurality of slots each of which extends around at least a portion of one of said switch assemblies to enable said laminations to receive magnetic flux emanating from said first, second and third stationary conductors and from said first, second and third movable conductors during a flow of electrical current through said first, second and third switch assemblies.

28. An apparatus as set forth in claim 27 wherein said first movable conductor includes a head end portion which has a first width in a direction transverse to a path of movement of said first movable conductor and a body portion which has a second width in a direction transverse to the path of movement of said first movable conductor, said second width being smaller than said first width, said second movable conductor having a head end portion which has a third width in a direction transverse to a path of movement of said second movable conductor and a body portion which has a fourth width in a direction transverse to the path of movement of said second movable conductor, said fourth width being smaller than said third width, said third movable conductor having a head end portion which has a fifth width in a direction transverse to a path of movement of said third moveable conductor and a body portion which has a sixth width in a direction transverse to the path of movement of said third movable conductor, said sixth width being greater than said fifth width, said slots extend around the head end portions of said first, second and third movable conductors and around the body portion of said first, second and third movable conductors.

29. An apparatus as set forth in claim 28 further including a plurality of filler members formed of electrically insulating material, said filler members being disposed in said slots.

30. An apparatus as set forth in claim 27 wherein said plurality of slots includes first, second and third slots extending through said stack of laminations, said first stationary conductor and said first movable conductor being at least partially disposed in said first slot, said second stationary conductor and said second movable conductor being at least partially disposed in said second slot, said third stationary conductor and said third movable conductor being at least partially disposed in said third slot, a first body of an electrically insulating material at least partially disposed in said first slot in said stack of laminations to at least partially block a first end portion of said first slot, said first body of electrically insulating material being at least partially disposed between said first stationary conductor and said first movable conductor, a second body of an electrically insulating material at least partially disposed in said second slot in said stack of laminations to at least partially block a first end portion of said second slot, said second body of electrically insulating material being at least partially disposed between said second stationary conductor and said second movable conductor, and a third body of an electrically insulating material at least partially disposed in said third slot in said stack of laminations to at least partially block a first end portion of said third slot, said third body of electrically insulating material being at least partially disposed between said third stationary conductor and said third movable conductor.

31. An apparatus as set forth in claim 30 further including a plurality of splitter plates disposed adjacent to second end portions of said first, second and third passages to receive arcs conducted between said first, second and third movable contacts and said first, second and third stationary contacts.

* * * * *